US009994933B2

(12) United States Patent
Gao et al.

(10) Patent No.: US 9,994,933 B2
(45) Date of Patent: Jun. 12, 2018

(54) COPPER ALLOY SHEET AND METHOD FOR PRODUCING SAME

(75) Inventors: Weilin Gao, Shizuoka (JP); Tomotsugu Aoyama, Shizuoka (JP); Hisashi Suda, Shizuoka (JP); Hiroto Narieda, Shizuoka (JP); Akira Sugawara, Shizuoka (JP); Akifumi Onodera, Shizuoka (JP)

(73) Assignee: DOWA METAL TECH CO., LTD., Tokyo (JP)

( * ) Notice: Subject to any disclaimer, the term of this patent is extended or adjusted under 35 U.S.C. 154(b) by 1024 days.

(21) Appl. No.: 12/767,074

(22) Filed: Apr. 26, 2010

(65) Prior Publication Data

US 2010/0269959 A1 Oct. 28, 2010

(30) Foreign Application Priority Data

Apr. 27, 2009 (JP) ..... 2009-107444
Sep. 28, 2009 (JP) ..... 2009-221812

(51) Int. Cl.

| | |
|---|---|
| ***C22C 9/00*** | (2006.01) |
| ***C22C 9/06*** | (2006.01) |
| ***C22C 9/10*** | (2006.01) |
| ***C22F 1/00*** | (2006.01) |
| ***C22F 1/08*** | (2006.01) |
| *H01R 13/03* | (2006.01) |

(52) U.S. Cl.
CPC ..... *C22C 9/06* (2013.01); *C22C 9/00* (2013.01); *C22F 1/00* (2013.01); *C22F 1/08* (2013.01); *H01R 13/03* (2013.01)

(58) Field of Classification Search
CPC ..... C22C 9/00; C22C 9/06; C22F 1/08
USPC ..... 148/432, 435; 420/485–488
See application file for complete search history.

(56) References Cited

U.S. PATENT DOCUMENTS 6,334,915 B1 1/2002 Ogura et al.
9,412,482 B2 * 8/2016 Kamada ..... H01B 1/026
(Continued)

FOREIGN PATENT DOCUMENTS

EP 0949343 10/1999
EP 1997920 12/2008
(Continued)

OTHER PUBLICATIONS

European Search Report for EP 10 004 288.6, dated Aug. 4, 2010.

*Primary Examiner* — Keith Walker
*Assistant Examiner* — John A Hevey
(74) *Attorney, Agent, or Firm* — Bachman & LaPointe, PC

(57) ABSTRACT

A copper alloy sheet has a chemical composition containing 0.7 to 4.0 wt % of Ni, 0.2 to 1.5 wt % of Si, and the balance being copper and unavoidable impurities, the copper alloy sheet having a crystal orientation which satisfies $I\{200\}/I_0\{200\} \geq 1.0$, assuming that the intensity of X-ray diffraction on the {200} crystal plane on the surface of the copper alloy sheet is I{200} and that the intensity of X-ray diffraction on the {200} crystal plane of the standard powder of pure copper is $I_0\{200\}$, and which satisfies $I\{200\}/I\{422\} \geq 15$, assuming that the intensity of X-ray diffraction on the {422} crystal plane on the surface of the copper alloy sheet is I{422}.

36 Claims, 3 Drawing Sheets

(56) References Cited

U.S. PATENT DOCUMENTS

| | | | | |
|---|---|---|---|---|
| 2005/0263218 | A1* | 12/2005 | Tanaka | C22C 9/06<br>148/433 |
| 2008/0190523 | A1* | 8/2008 | Gao et al. | 148/682 |
| 2008/0298998 | A1 | 12/2008 | Kaneko et al. | |

FOREIGN PATENT DOCUMENTS

| | | |
|---|---|---|
| JP | 2000-80428 | 3/2000 |
| JP | 2006-9108 | 1/2006 |
| JP | 2006-9137 | 1/2006 |
| JP | 2006-16629 | 1/2006 |
| JP | 2006-152392 | 6/2006 |
| WO | 2009/122869 | 10/2009 |
| WO | 2009/148101 | 12/2009 |

* cited by examiner

COPPER ALLOY SHEET AND METHOD FOR PRODUCING SAME

BACKGROUND OF THE INVENTION

Field of the Invention

The present invention generally relates to a copper alloy sheet and a method for producing the same. More specifically, the invention relates to a sheet of a copper alloy containing nickel and silicon (a sheet of a Cu—Ni—Si alloy), which is used as the material of electric and electronic parts, such as connectors, lead frames, relays and switches, and a method for producing the same.

Description of the Prior Art

The materials used for electric and electronic parts as the materials of current-carrying parts, such as connectors, lead frames, relays and switches, are required to have a good electric conductivity in order to suppress the generation of Joule heat due to the carrying of current, as well as such a high strength that the materials can withstand the stress applied thereto during the assembly and operation of electric and electronic apparatuses using the parts. The materials used for electric and electronic parts, such as connectors, are also required to have an excellent bending workability since the parts are generally formed by bending after press blanking. Moreover, in order to ensure the contact reliability between electric and electronic parts, such as connectors, the materials used for the parts are required to have an excellent stress relaxation resistance, i.e., a resistance to such a phenomenon (stress relaxation) that the contact pressure between the parts is deteriorated with age.

Particularly in recent years, there is a tendency for electric and electronic parts, such as connectors, to be integrated, miniaturized and lightened. In accordance therewith, the sheets of copper and copper alloys serving as the materials of the parts are required to be thinned, so that the required strength level of the materials is more severe. Specifically, the tensile strength of the materials is desired to be the strength level of not less than 700 MPa, preferably not less than 750 MPa, and more preferably not less than 800 MPa.

However, there is generally a trade-off relationship between the strength and bending workability of a copper alloy sheet, so that it is difficult to obtain a copper alloy sheet satisfying both of the desired strength and bending workability as the required strength level of the material is more severe. In the case of a typical copper alloy sheet manufactured by rolling operations, it is known that the bending workability of the sheet in a bad way bending, in which the bending axis of the sheet is a rolling direction (LD), is greatly different from that in a good way bending in which the bending axis of the sheet is a direction (TD) perpendicular to the rolling direction and thickness direction. That is, it is known that the anisotropy of the bending workability of the copper alloy sheet is great. In particular, copper alloy sheets used as the materials of electric and electronic parts, such as connectors, which are small and have complicated shapes, are often formed by both of the good way bending and bad way bending. Therefore, it is strongly desired that the strength level of a copper alloy sheet is not only enhanced, but the anisotropy of the bending workability of the copper alloy sheet is also improved.

In addition, with the increase of cases where electric and electronic parts, such as connectors, are used in severe environments, the requirements for the stress relaxation resistance of copper alloy sheets used for the materials of the parts are more severe. For example, the stress relaxation resistance of electric and electronic parts, such as connectors, is particularly important when the parts are used for automobiles in high-temperature environments. Furthermore, the stress relaxation resistance is such a kind of creep phenomenon that the contact pressure on a spring portion of a material forming electric and electronic parts, such as connectors, is deteriorated with age in a relatively high-temperature (e.g., 100 to 200° C.) environment even if it is maintained to be a constant contact pressure at ordinary temperature. That is, the stress relaxation resistance is such a phenomenon that the stress applied to a metal material is relaxed by plastic deformation produced by the movement of dislocation, which is caused by the self-diffusion of atoms forming a matrix and the diffusion of the solid solution of atoms, in such a state that the stress is applied to the metal material.

However, there are generally trade-off relationships between the strength and electric conductivity of a copper alloy sheet and between the bending workability and stress relaxation resistance thereof, in addition to the above-described trade-off relationship between the strength and bending workability thereof. Therefore, conventionally, a copper alloy sheet having a good strength, bending workability or stress relaxation resistance is suitably chosen in accordance with the use thereof as a material used for a current-carrying part, such as a connector.

Among copper alloy sheets used for the materials of electric and electronic parts, such as connectors, the sheets of Cu—Ni—Si alloys (so-called Corson alloys) are noted as materials having a relatively excellent characteristic balance between the strength and electric conductivity thereof. For example, the sheets of Cu—Ni—Si alloys can have the strength of not less than 700 MPa while maintaining a relatively high electric conductivity (30 to 50% IACS) by a process basically comprising a solution treatment, cold-rolling, ageing treatment, finish cold-rolling and low-temperature annealing. However, the bending workability of the sheets of Cu—Ni—Si alloys is not always good since they have a high strength.

As methods for improving the strength of the sheets of Cu—Ni—Si alloys, there are known a method for increasing the amount of solute elements, such as Ni and Si, to be added, and a method for enhancing a rolling reduction in a finish rolling (temper rolling) operation after an ageing treatment. However, in the method for increasing the amount of solute elements, such as Ni and Si, to be added, the electric conductivity of the sheets of the alloys is deteriorated, and the amount of Ni—Si deposits is increased to easily deteriorate the bending workability thereof. On the other hand, in the method for enhancing the rolling deduction in the finish rolling operation after the ageing treatment, the extent of work hardening is enhanced to remarkably deteriorate the bad way bending workability, so that there are some cases where the sheets can not be worked as electric and electronic parts, such as connectors, even if the strength and electric conductivity thereof are high.

As a method for preventing the deterioration of the bending workability of the sheets of Cu—Ni—Si alloys, there is known a method for omitting the finish cold-rolling after the ageing treatment or minimizing the cold-rolling reduction as well as compensating the deterioration of the strength of the sheets by increasing the amount of solute elements, such as Ni and Si, to be added thereto. However, in this method, there is a problem in that the bending workability in the good way is remarkably deteriorated.

In order to improve the bending workability of the sheets of copper alloys, a method for fining the crystal grains of the copper alloys is effective. This is the same in the case of the sheets of Cu—Ni—Si alloys. Therefore, the solution treatment for the sheets of Cu—Ni—Si alloys is often carried out in a relatively low temperature range so as to cause part of deposits (or crystallized substances) for pinning the growth of recrystallized grains to remain, not in a high temperature range in which all of the deposits (or crystallized substances) are caused to form the solid solution thereof. However, if the solution treatment is carried out in such a low temperature range, the strength level of the sheets after the ageing treatment is necessarily lowered since the amount of the solid solution of Ni and Si is decreased although the crystal grains can be fined. In addition, since the area of grain boundaries existing per a unit volume is increased as the crystal grain size is decreased, the fining of the crystal grains causes to promote stress relaxation being a kind of creep phenomenon. In particular, in sheets used as the materials of automotive connectors or the like in high-temperature environments, the diffusion rate along the grain boundaries of atoms is far higher than that in the grains, so that the deterioration of the stress relaxation resistance of the sheets due to grain refining causes a serious problem.

In recent years, as methods for improving such a problem on the bending workability of the sheets of Cu—Ni—Si alloys, there are proposed various methods for improving the bending workability of the sheets by controlling the crystal orientation (texture). For example, there are proposed a method for improving the bending workability of a sheet in the good way by causing $(I\{111\}+I\{311\})/I\{220\}\leq 2.0$ to be satisfied assuming that the intensity of the X-ray diffraction on a {hkl} plane is I{hkl} (see, e.g., Japanese Patent Laid-Open No. 2006-9108), and a method for improving the bending workability of a sheet in the bad way by causing $(I\{111\}+I\{311\})/I\{220\}>2.0$ to be satisfied assuming that the intensity of the X-ray diffraction on a {hkl} plane is I{hkl} (see, e.g., Japanese Patent Laid-Open No. 2006-16629). There is also proposed a method for improving the bending workability of the sheets of Cu—Ni—Si alloys by causing the sheets to have a mean crystal grain size of 10 μm or less and such a texture that the percentage of the Cube orientation {001}<100>, which is known as one of recrystallized textures, is 50% or more in the results of measurement based on the SEM-EBSP method (see, e.g., Japanese Patent Laid-Open No. 2006-152392). In addition, there is proposed a method for improving the bending workability of the sheets of Cu—Ni—Si alloys by causing $(I\{200\}+I\{311\})/I\{220\}\geq 0.5$ to be satisfied (see, Japanese Patent Laid-Open No. 2000-80428). Moreover, there is proposed a method for improving the bending workability of the sheet of a Cu—Ni—Si alloy by causing $I\{311\}\times A/(I\{311\}+I\{220\}+I\{200\})<1.5$ to be satisfied assuming that the crystal grain size of the sheet is A (μm) and that the intensities of X-ray diffraction from the {311}, {220} and {200} planes on the surface of the sheet are I{311}, I{220} and I{200}, respectively (see, Japanese Patent Laid-Open No. 2006-9137).

Furthermore, the pattern of X-ray diffraction from the surface (rolled surface) of the sheet of a Cu—Ni—Si alloy generally comprises the peaks of diffraction on five crystal planes of {111}, {200}, {220}, {311} and {422}. The intensities of X-ray diffraction from other crystal planes are far smaller than those from the five crystal planes. The intensities of X-ray diffraction on the {200}, {311} and {422} planes are usually increased after a solution treatment (recrystallization). The intensities of X-ray diffraction on these planes are decreased by the subsequent cold rolling operation, so that the intensity of X-ray diffraction on the {220} plane is relatively increased. Usually, the intensity of X-ray diffraction on the {111} plane is not so varied by the cold rolling operation. Therefore, in the above described Japanese Patent Laid-Open Nos. 2006-9108, 2006-16629, 2006-152392, 2000-80428 and 2006-9137, the crystal orientation (fixture) of Cu—Ni—Si alloys is controlled by the intensities of X-ray diffraction from these crystal planes.

However, in the method disclosed in Japanese Patent Laid-Open No. 2006-9108, the bending workability of a sheet in the good way is improved by causing $(I\{111\}+I\{311\})/I\{220\}\leq 2.0$ to be satisfied, whereas in the method disclosed in Japanese Patent Laid-Open No. 2006-16629, the bending workability of a sheet in the bad way by causing $(I\{111\}+I\{311\})/I\{220\}>2.0$ to be satisfied, so that the conditions of the improvement of the bending workability of a sheet in the good way is reverse to those in the bad way. Therefore, it is difficult to improve the bending workability of a sheet in both of the good and bad ways by the methods disclosed in Japanese Patent Laid-Open Nos. 2006-9108 and 2006-16629.

In the method disclosed in Japanese Patent Laid-Open No. 2006-152392, the stress relaxation resistance of the sheets is often deteriorated since it is required to fine the crystal grains of the sheets to cause the sheets to have a mean crystal grain size of 10 μm or less.

In the method disclosed in Japanese Patent Laid-Open No. 2000-80428, it is required to decrease the percentage of the {220} crystal plane, which is the principal orientation of rolling texture, so as to cause $(I\{200\}+I\{311\})/I\{220\}\geq 0.5$ to be satisfied. For that reason, if the rolling reduction in the cold rolling after the solution treatment is decreased, it is possible to improve the bending workability of the sheets. However, if the sheets are so controlled as to have such a rolling texture, the strength of the sheets is often decreased, so that the tensile strength thereof is about 560 to 670 MPa.

In the method disclosed in Japanese Patent Laid-Open No. 2006-9137, it is required to fine the crystal grains in order to improve the bending workability of the sheet, so that the stress relaxation resistance of the sheet is often deteriorated.

As described above, although a method for fining the crystal grains of a copper alloy sheet is effective in order to improve the bending workability of the sheet, the stress relaxation resistance of the sheet is deteriorated by fining the crystal grains of the sheet, so that it is difficult to improve both of the bending workability and stress relaxation resistance of the sheet.

SUMMARY OF THE INVENTION

It is therefore an object of the present invention to eliminate the aforementioned problems and to provide a Cu—Ni—Si alloy sheet having an excellent bending workability with a small anisotropy and an excellent stress relaxation resistance while maintaining a high strength which is a tensile strength of not less than 700 MPa, and a method for producing the same.

In order to accomplish the aforementioned and other objects, the inventors have diligently studied and found that it is possible to improve the bending workability of a copper alloy sheet, which has a chemical composition containing 0.7 to 4.0 wt % of nickel, 0.2 to 1.5 wt % of silicon and the balance being copper and unavoidable impurities, while remarkably improving the anisotropy thereof without deteriorating the stress relaxation resistance thereof, by increasing the percentage of crystal grains of the {200} crystal plane orientation (Cube orientation) having a small anisotropy while decreasing the percentage of crystal grains of {422} crystal plane orientation having a great anisotropy, and that it is possible to improving both of the stress relaxation resistance and bending workability of the copper alloy sheet by enhancing the mean twin crystal density in the crystal grains thereof. Thus, the inventors have made the present invention.

According one aspect of the present invention, there is provided a copper alloy sheet having a chemical composition containing 0.7 to 4.0 wt % of nickel, 0.2 to 1.5 wt % of silicon, and the balance being copper and unavoidable impurities, wherein the copper alloy sheet has a crystal orientation which satisfies $I\{200\}/I_0\{200\} \geq 1.0$, assuming that the intensity of X-ray diffraction on the {200} crystal plane on the surface of the copper alloy sheet is I{200} and that the intensity of X-ray diffraction on the {200} crystal plane of the standard powder of pure copper is $I_0\{200\}$.

In this copper alloy sheet, the crystal orientation of the copper alloy sheet preferably satisfies $I\{200\}/I\{422\} \geq 15$, assuming that the intensity of X-ray diffraction on the {422} crystal plane on the surface of the copper alloy sheet is I{422}. In addition, the copper alloy sheet preferably has a mean crystal grain size D which is in the range of from 6 μm to 60 μm, the mean crystal grain size D being obtained without including twin crystal boundaries while distinguishing crystal grain boundaries from the twin crystal boundaries on the surface of the copper alloy sheet by the method of section based on JIS H0501. In this case, the copper alloy sheet preferably has a mean twin crystal density $N_G=(D-D_T)/D_T$, which is not less than 0.5, the mean twin crystal density being derived from the mean crystal grain size D and a mean crystal grain size $D_T$ which is obtained while including twin crystal boundaries without distinguishing crystal grain boundaries from the twin crystal boundaries on the surface of the copper alloy sheet by the method of section based on JIS H0501.

In the copper alloy sheet, the chemical composition of the copper alloy sheet may further contain one or more elements which are selected from the group consisting of 0.1 to 1.2 wt % of tin, not higher than 2.0 wt % of zinc, not hither than 1.0 wt % of magnesium, not higher than 2.0 wt % of cobalt, and not higher than 1.0 wt % of iron. The chemical composition of the copper alloy sheet may further contain one or more elements which are selected from the group consisting of chromium, boron, phosphorus, zirconium, titanium, manganese, silver, beryllium and misch metal, the total amount of these elements being not higher than 3 wt %. The copper alloy sheet preferably has a tensile strength of not less than 700 MPa. If the copper alloy sheet has a tensile strength of not less than 800 MPa, the crystal orientation preferably satisfies $I\{200\}/I\{422\} \geq 50$.

According to another aspect of the present invention, there is provided a copper alloy sheet having a chemical composition containing 0.7 to 4.0 wt % of nickel, 0.2 to 1.5 wt % of silicon, and the balance being copper and unavoidable impurities, wherein the copper alloy sheet has a mean crystal grain size D which is in the range of from 6 μm to 60 μm, the mean crystal grain size D being obtained without including twin crystal boundaries while distinguishing crystal grain boundaries from the twin crystal boundaries on the surface of the copper alloy sheet by the method of section based on JIS H0501, and wherein the copper alloy sheet has a mean twin crystal density $N_G=(D-D_T)/D_T$, which is not less than 0.5, the mean twin crystal density being derived from the mean crystal grain size D and a mean crystal grain size $D_T$ which is obtained while including twin crystal boundaries without distinguishing crystal grain boundaries from the twin crystal boundaries on the surface of the copper alloy sheet by the method of section based on JIS H0501.

In this copper alloy sheet, the chemical composition of the copper alloy sheet may further contain one or more elements which are selected from the group consisting of 0.1 to 1.2 wt % of tin, not higher than 2.0 wt % of zinc, not hither than 1.0 wt % of magnesium, not higher than 2.0 wt % of cobalt, and not higher than 1.0 wt % of iron. The chemical composition of the copper alloy sheet may further contain one or more elements which are selected from the group consisting of chromium, boron, phosphorus, zirconium, titanium, manganese, silver, beryllium and misch metal, the total amount of these elements being not higher than 3 wt %. The copper alloy sheet preferably has a tensile strength of not less than 700 MPa. If the copper alloy sheet has a tensile strength of not less than 800 MPa, the crystal orientation preferably satisfies $I\{200\}/I\{422\} \geq 50$.

According to a further aspect of the present invention, there is provided a method for producing a copper alloy sheet, the method comprising: a melting and casting step of melting and casting raw materials of a copper alloy, the copper alloy having a chemical composition which contains 0.7 to 4.0 wt % of nickel, 0.2 to 1.5 wt % of silicon, and the balance being copper and unavoidable impurities; a hot rolling step of carrying out a hot rolling operation while lowering temperature in the range of from 950° C. to 400° C., after the melting and casting step; a first cold rolling step of carrying out a cold rolling operation at a rolling reduction of not less than 30%, after the hot rolling step; a process annealing step of carrying out a heat treatment at a heating temperature of 450 to 600° C., after the first cold rolling step; a second cold rolling step of carrying out a cold rolling operation at a rolling reduction of not less than 70%, after the process annealing step; a solution treatment step of carrying out a solution treatment at a temperature of 700 to 980° C., after the second cold rolling step; an intermediate cold rolling step of carrying out a cold rolling operation at a rolling reduction of 0 to 50%, after the solution treatment step; and an ageing treatment step of carrying out an ageing treatment at a temperature of 400 to 600° C., after the intermediate cold rolling step, wherein the heat treatment at the process annealing step is carried out so as to cause a ratio Ea/Eb of an electric conductivity Ea after the heat treatment to an electric conductivity Eb before the heat treatment to be 1.5 or more while causing a ratio Ha/Hb of a Vickers hardness Ha after the heat treatment to a Vickers hardness Hb before the heat treatment to be 0.8 or less.

In this method for producing a copper alloy sheet, the temperature and time for carrying out the solution treatment at the solution treatment step are preferably set so that the mean crystal grain size after the solution treatment is in the range of from 10 μm to 60 μm. The method for producing a copper alloy sheet preferably further comprises a finish cold rolling step of carrying out a cold rolling operation at a rolling reduction of not higher than 50%, after the ageing treatment step. The method for producing a copper alloy sheet preferably further comprises a low temperature annealing step for carrying out a heat treatment at a temperature of 150 to 550° C., after the finish cold rolling step.

In the method for producing a copper alloy sheet, the chemical composition of the copper alloy sheet may further contain one or more elements which are selected from the group consisting of 0.1 to 1.2 wt % of tin, not higher than 2.0 wt % of zinc, not hither than 1.0 wt % of magnesium, not higher than 2.0 wt % of cobalt, and not higher than 1.0 wt % of iron. The chemical composition of the copper alloy sheet may further contain one or more elements which are selected from the group consisting of chromium, boron, phosphorus, zirconium, titanium, manganese, silver, beryllium and misch metal, the total amount of these elements being not higher than 3 wt %.

According to a still further aspect of the present invention, there is provided an electric and electronic part, wherein the above-described copper alloy sheet is used as the material thereof. This electric and electronic part is preferably any one of a connector, a lead frame, a relay and a switch.

Throughout the specification, the "mean crystal grain size obtained without including twin crystal boundaries by the method of section based on JIS H0501" means a true mean crystal grain size obtained without including twin crystal boundaries (i.e., without counting the number of twin crystal boundaries) when the number of crystal grains completely cut by line segments having well known lengths on an image or photograph of a microscope is counted to obtain the mean crystal grain size from the mean value of the cut lengths in accordance with the method of section based on JIS H0501.

Throughout the specification, the "mean crystal grain size obtained while including twin crystal boundaries by the method of section based on JIS H0501" means a mean crystal grain size obtained while including twin crystal boundaries (i.e., while counting the number of twin crystal boundaries) when the number of crystal grains completely cut by line segments having well known lengths on an image or photograph of a microscope is counted to obtain the mean crystal grain size from the mean value of the cut lengths in accordance with the method of section based on in JIS H0501.

According to the present invention, it is possible to produce a Cu—Ni—Si alloy sheet having an excellent bending workability and an excellent stress relaxation resistance while maintaining a high strength which is a tensile strength of not less than 700 MPa, and particularly, having such a small anisotropy that the bending workability of the sheet is excellent in both of the good way and bad way.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Figure 1:
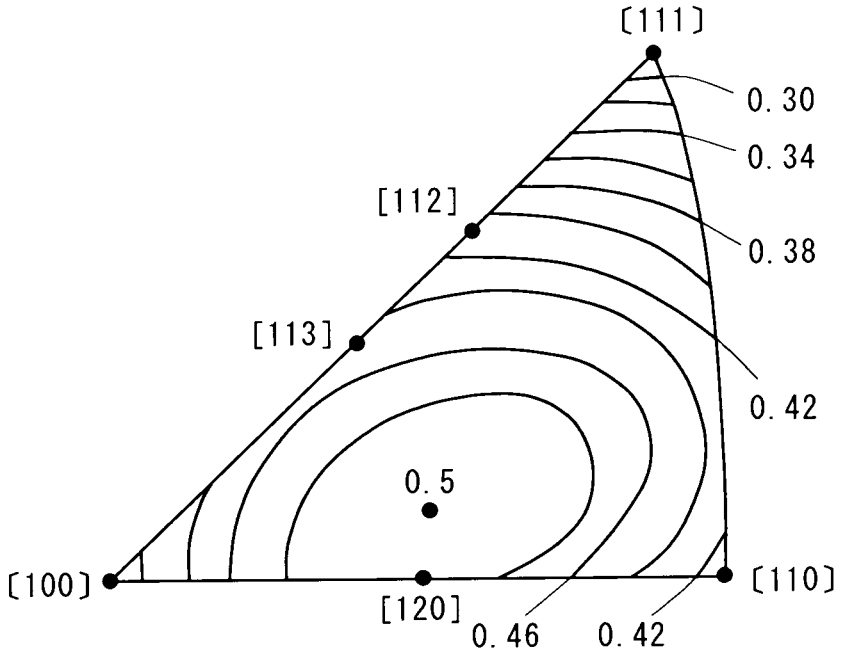
FIG. 1 is a standard reversed pole figure which shows the Schmid factor distribution of a face-centered cubic crystal.

The preferred embodiment of a copper alloy sheet according to the present invention has a chemical composition consisting of: 0.7 to 4.0 wt % of nickel (Ni); 0.2 to 1.5 wt % of silicon (Si); optionally one or more elements which are selected from the group consisting of 0.1 to 1.2 wt % of tin (Sn), 2.0 wt % or less of zinc (Zn), 1.0 wt % or less of magnesium (Mg), 2.0 wt % or less of cobalt (Co) and 1.0 wt % or less of iron (Fe); optionally one or more elements which are selected from the group consisting of chromium (Cr), boron (B), phosphorus (P), zirconium (Zr), titanium (Ti), manganese (Mn), silver (Ag), beryllium (Be) and misch metal, the total amount of these elements being 3 wt % or less; and the balance being copper and unavoidable impurities.

The copper alloy sheet has a crystal orientation which satisfies $I\{200\}/I_0\{200\} \geq 1.0$, assuming that the intensity of X-ray diffraction on the {200} crystal plane on the surface of the copper alloy sheet is I{200} and that the intensity of X-ray diffraction on the {200} crystal plane of the standard powder of pure copper is $I_0\{200\}$, and which satisfies $I\{200\}/I\{422\} \geq 15$, assuming that the intensity of X-ray diffraction on the {422} crystal plane on the surface of the copper alloy sheet is I{422}.

The mean crystal grain size D of the copper alloy sheet is preferably in the range of from 6 μm to 60 μm, the mean crystal grain size D being obtained without including twin crystal boundaries while distinguishing crystal grain boundaries from the twin crystal boundaries on the surface of the copper alloy sheet by the method of section based on JIS H0501.

The mean twin crystal density $N_G=(D-D_T)/D_T$ is preferably not less than 0.5, the mean twin crystal density being derived from the mean crystal grain size D, which is obtained without including twin crystal boundaries, and a mean crystal grain size $D_T$ which is obtained while including twin crystal boundaries without distinguishing crystal grain boundaries from the twin crystal boundaries on the surface of the copper alloy sheet by the method of section based on JIS H0501.

The tensile strength of the copper alloy sheet is preferably not less than 700 MPa. When the tensile strength of the copper alloy sheet is not less than 800 MPa, the copper alloy sheet preferably has a crystal orientation which satisfies $I\{200\}/I\{422\} \geq 50$.

Such a copper alloy sheet and a method for producing the same will be described below in detail.

[Composition of Alloy]

The preferred embodiment of a copper alloy sheet according to the present invention is a sheet of a Cu—Ni—Si alloy containing Cu, Ni and Si. The copper alloy sheet may optionally contain a small amount of Sn, Zn and other elements in addition to the three basic elements of the Cu—Ni—Si ternary alloy.

Nickel (Ni) and silicon (Si) have the functions of generating Ni—Si deposits to improve the strength and electric conductivity of the copper alloy sheet. If the content of Ni is less than 0.7 wt % and/or if the content of Si is less than 0.2 wt %, it is difficult to sufficiently provide these functions. Therefore, the content of Ni is preferably not less than 0.7 wt %, more preferably not less than 1.2 wt %, and most preferably not less than 1.5 wt %. The content of Si is preferably not less than 0.2 wt %, more preferably not less than 0.3 wt %, and most preferably not less than 0.35 wt %. On the other hand, if the contents of Ni and Si are too high, coarse deposits are easily generated to cause cracks in the copper alloy sheet during bending, so that the bending workability of the copper alloy sheet in both of the good way and bad way is easily deteriorated. Therefore, the content of Ni is preferably not higher than 4.0 wt %, more preferably not higher than 3.5 wt %, and most preferably not higher than 2.5 wt %. The content of Si is preferably not higher than 1.5 wt %, more preferably not higher than 1.0 wt %, and most preferably not higher than 0.8 wt %.

It is considered that the Ni—Si deposits formed by Ni and Si are intermetallic compounds mainly containing $Ni_2Si$. However, an aging treatment does not always cause all of Ni and Si in the alloy to be deposits, and Ni and Si in the alloy exist as a solid solution in a Cu matrix to some extent. Although the solid solution of Ni and Si slightly improves the strength of the copper alloy sheet, the function of improving the strength of the copper alloy sheet is smaller than that of the deposits, and it causes to deteriorate the electric conductivity thereof. For that reason, the ratio of the content of Ni to the content of Si is preferably close to the composition ratio of deposits $Ni_2Si$. Therefore, the mass ratio of Ni/Si is preferably adjusted to be in the range of from 3.5 to 6.0, and more preferably in the range of from 3.5 to 5.0. However, if the copper alloy sheet contains an element, such as Co or Cr, which can generate deposits with Si, the mass ratio of Ni/Si is preferably adjusted to be in the range of from 1.0 to 4.0.

Tin (Sn) has the function of carrying out the solid-solution strengthening (or hardening) of the copper alloy. In order to sufficiently provide this function, the content of Sn is preferably not less than 0.1 wt %, and more preferably not less than 0.2 wt %. On the other hand, if the content of Sn exceeds 1.2 wt %, the electric conductivity of the copper alloy is remarkably lowered. Therefore, the content of Sn is preferably not higher than 1.2 wt %, and more preferably not higher than 0.7 wt %.

Zinc (Zn) has the function of improving the castability of the copper alloy, in addition to the function of improving the solderability and strength thereof. If the copper alloy contains Zn, inexpensive brass scraps may be used. In order to sufficiently provide these functions, the content of Zn is preferably not less than 0.1 wt %, and more preferably not less than 0.3 wt %. However, if the content of Zn exceeds 2.0 wt %, the electric conductivity and stress corrosion cracking resistance of the copper alloy sheet are easily deteriorated. Therefore, if the copper alloy contains Zn, the content of Zn is preferably not higher than 2.0 wt %, and more preferably not higher than 1.0 wt %.

Magnesium (Mg) has the functions of preventing Ni—Si deposits from being coarsened and of improving the stress relaxation resistance of the copper alloy sheet. In order to sufficiently provide these functions, the content of Mg is preferably not less than 0.01 wt %. However, if the content exceeds 1.0 wt %, the castability and hot-workability of the copper alloy are easily deteriorated. Therefore, if the copper alloy sheet contains Mg, the content of Mg is preferably not higher than 1.0 wt %.

Cobalt (Co) has the function of improving the strength and electric conductivity of the copper alloy sheet. That is, Co is an element capable of generating deposits with Si and of depositing alone. If the copper alloy sheet contains Co, it reacts with the solid solution of Si in the Cu matrix to generate deposits, and excessive Co deposits alone, so that the strength and electric conductivity thereof are improved. In order to sufficiently provide these functions, the content of Co is preferably not less than 0.1 wt %. However, Co is an expensive element, so that the content of Co is preferably not higher than 2.0 wt % since the costs are increased if the copper alloy sheet contains excessive Co. Therefore, if the copper alloy sheet contains Co, the content of Co is preferably in the range of from 0.1 wt % to 2.0 wt %, and more preferably in the range of from 0.5 wt % to 1.5 wt %. In addition, if the copper alloy sheet contains Co, it preferably contains such an excessive amount of Si that the mass ratio of Si/Co is in the range of from 0.15 to 0.3, since there is some possibility that the amount of Si capable of generating Ni—Si deposits is decreased if deposits of Co and Si are generated.

Iron (Fe) has the function of improving the bending workability of the copper alloy sheet by promoting the generation of the {200} orientation of recrystallized grains after a solution treatment and by suppressing the generation of the {220} orientation thereof. That is, if the copper alloy sheet contains Fe, the bending workability thereof is improved by the decrease of the {220} orientation density and the increase of the {200} orientation density. In order to sufficiently provide this function, the content of Fe is preferably not less than 0.05 wt %. However, if the content of Fe is excessive, the electric conductivity of the copper alloy sheet is remarkably lowered, so that the content of Fe is preferably not higher than 1.0 wt %. Therefore, if the copper alloy sheet contains Fe, the content of Fe is preferably in the range of from 0.05 wt % to 1.0 wt %, and more preferably in the range of from 0.1 wt % to 0.5 wt %.

As other elements which may be optionally added to the copper alloy sheet, there are chromium (Cr), boron (B), phosphorus (P), zirconium (Zr), titanium (Ti), manganese (Mn), silver (Ag), beryllium (Be), misch metal and so forth. For example, Cr, B, P, Zr, Ti, Mn and Be have the functions of further enhancing the strength of the copper alloy sheet and of decreasing the stress relaxation thereof. In addition, Cr, Zr, Ti and Mn are easy to form high melting point compounds with S, Pb and so forth, which exist as unavoidable impurities in the copper alloy sheet, and B, P, Zr and Ti have the functions of fining the cast structure of the copper alloy and of improving the hot workability thereof. Moreover, Ag has the function of carrying out the solid-solution strengthening (or hardening) of the copper alloy sheet without greatly deteriorating the electric conductivity thereof. The misch metal is a mixture of rare earth elements containing Ce, La, Dy, Nd, Y and so forth, and has the functions of refining crystal grains and of dispersing deposits.

If the copper alloy sheet contains at least one element which is selected from the group consisting of Cr, B, P, Zr, Ti, Mn, Ag, Be and misch metal, the total amount of these elements is preferably not less than 0.01 wt % in order to sufficiently provide the function of each element. However, if the total amount of these elements exceeds 3 wt %, the elements have a bad influence on the hot workability or cold workability thereof, and it is unfavorable with respect to costs. Therefore, the total amount of these elements is preferably not higher than 3 wt %, and more preferably not higher than 2 wt %.

[Texture]

The texture of Cu—Ni—Si copper alloys generally comprises {100}<001>, {110}<112>, {113}<112>, {112}<111> and intermediate orientations thereof. The pattern of X-ray diffraction from a direction (ND) perpendicular to the surface (rolled surface) of the copper alloy sheets generally comprises the peaks of diffraction on four crystal planes of {200}, {220}, {311} and {422}.

There are Schmid factors as indexes which indicate the probability of generating plastic deformation (slip) when an external force is applied to a crystal in a certain direction. Assuming that the angle between the direction of the external force applied to the crystal and the normal line to the slip plane is $\phi$ and that the angle between the direction of the external force applied to the crystal and the slip direction is $\lambda$, the Schmid factors are expressed by $\cos\phi \cdot \cos\lambda$, and the values thereof are not greater than 0.5. If the Schmid factor is greater (i.e., if the Schmid factor approaches 0.5), it means that shearing stress in slip directions is greater. Therefore, if the Schmid factor is greater (i.e., if the Schmid factor approaches 0.5) when an external force is applied to a crystal in a certain direction, the crystal is easily deformed. The crystal structure of Cu—Ni—Si alloys is the face centered cubic (fcc). The slip system of a face-centered cubic crystal has a slip plane of {111} and a slip direction of <110>. The actual crystal is easily deformed to decrease the extent of work hardening as the Schmid factor is greater.

FIG. 1 is a standard reversed pole figure which shows the Schmid factor distribution of a face-centered cubic crystal. As shown in FIG. 1, the Schmid factor in the <120> direction is 0.490 which is close to 0.5. That is, a face-centered cubic crystal is very easy to be deformed if an external force is applied to the crystal in the <120> direction. The Schmid factors in other directions are 0.408 in the <100> direction, 0.445 in the <113> direction, 0.408 in the <110> direction, 0.408 in the <112> direction, and 0.272 in the <111> direction.

The {200} crystal plane ({100}<001> orientation) has similar characteristics in the three directions of ND, LD and TD, and is generally called Cube orientation. The number of combinations of slip planes with slip directions, in which both of LD:<001> and TD:<010> can contribute to slip, is eight among twelve combinations, and all of the Schmid factors thereof are 0.41. Moreover, it was found that the slip line on the {200} crystal plane allows the bending deformation of the copper alloy sheet without forming shear zones since it is possible to improve the symmetric properties of 45° and 135° with respect to the bending axis. That is, it was found that the Cube orientation causes the bending workability of the copper alloy sheet in both of the good way and bad way to be good, and does not cause any anisotropy.

Although it is known that the Cube orientation is the principal orientation of a pure copper type recrystallized texture, it is difficult to develop the Cube orientation by a typical method for producing a copper alloy sheet. However, as will be described later, in the preferred embodiment of a method for producing a copper alloy sheet according to the present invention, a copper alloy sheet having a crystal orientation, in which the Cube orientation is developed, can be obtained by appropriately controlling the conditions in the process annealing and solution treatment.

The {220} crystal plane ({110}<112> orientation) is the principal orientation of a brass (alloy) type rolling texture, and is generally called Brass orientation (or B orientation). The LD of the B orientation is the <112> direction, and the TD thereof is the <111> direction. The Schmid factors in LD and Td are 0.408 and 0.272, respectively. That is, the bending workability in the bad way is generally deteriorated by the development of the B orientation with the increase of the finish rolling reduction. However, the finish rolling after the ageing treatment is effective in order to improve the strength of the copper alloy sheet. Therefore, as will be described later, in the preferred embodiment of a method for producing a copper alloy sheet according to the present invention, both of the strength of the copper alloy sheet and the bending workability in the bad way thereof can be improved by restricting the finish rolling reduction after the ageing treatment.

The {311} crystal plane ({113}<112> orientation) is the principal orientation of a brass (alloy) type rolling texture. If the {113}<112> orientation is developed, the bending workability of the copper alloy sheet in the bad way can be improved, but the bending workability thereof in the good way is deteriorated, so that the anisotropy in the bending workability is increased. As will be described later, in the preferred embodiment of a method for producing a copper alloy sheet according to the present invention, the Cube orientation after the solution treatment is developed to necessarily restrain the generation of the {113}<112> orientation, so that the anisotropy in the bending workability can be improved.

It was found that there are some cases where Cu—Ni—Si alloys have a recrystallized texture wherein the {422} crystal plane remains on the rolled surface by the solution treatment, and that the volume percentage thereof is not greatly changed by the ageing treatment and rolling before the solution treatment. Therefore, after a single crystal Cu—Ni—Si alloy sheet was used for examining the bending workability in this orientation, it was found that the bending workability in both of the good way and bad way is far worse than the bending workability in other orientations. Thus, it was also found that deep cracks are easily developed in Cu—Ni—Si alloy sheets in which the {422} crystal plane is developed, even if the volume percentage of the {422} crystal plane is only about 10 to 20% since the crystal having this orientation serves as the origin of cracks.

In the standard powder of pure copper having a random orientation state, I{200}/I{422}=9. However, if a Cu—Ni—Si alloy sheet having a usual chemical composition is obtained by a usual producing process, I{200}/I{422}=2 to 5 which is low, so that it can be seen that the existing percentage of the {422} plane serving as the origin of cracks during bending is high.

The {422} crystal plane ({112}<111> orientation) is the principal orientation of a pure copper type rolling texture. As will be described later, in the preferred embodiment of a method for producing a copper alloy sheet according to the present invention, the conditions in the process annealing and solution treatment are appropriately controlled, so that the percentage of the {422} crystal plane existing after the solution treatment can be decreased to obtain the crystal orientation satisfying I{200}/I{422}≥15. If the percentage of the existing {422} crystal plane is further decreased to obtain the crystal orientation satisfying I{200}/I{422}≥50, the bending workability in both of the good way and bad way can be remarkably improved even if the copper alloy plate has a tensile strength of not less than 800 MPa.

[Crystal Orientation]

The bending workability of a Cu—Ni—Si copper alloy sheet in both of the good way and bad way can be improved so that the anisotropy in the bending workability can be improved, if the texture having the {200} crystal plane (Cube orientation) as a principal orientation component is stronger by the solution treatment. Therefore, the copper alloy sheet has a crystal orientation which preferably satisfies $I\{200\}/I_0\{200\}\geq 1.0$, more preferably satisfies $I\{200\}/I_0\{200\}\geq 1.5$, and most preferably satisfies $I\{200\}/I_0\{200\}\geq 2.0$, assuming that the intensity of X-ray diffraction on the {200} crystal plane on the surface of the copper alloy sheet is I{200} and that the intensity of X-ray diffraction on the {200} crystal plane of the standard powder of pure copper is $I_0\{200\}$.

Since the {422} crystal plane causes the deterioration of the bending workability of the copper alloy sheet even if the amount thereof is small, it is required to maintain the high strength and excellent bending workability of the copper alloy sheet by maintaining the low volume percentage of the {422} crystal plane after the solution treatment. Therefore, the copper alloy sheet has a crystal orientation which preferably satisfies I{200}/I{422}≥15, assuming that the intensity of X-ray diffraction on the {422} crystal plane on the surface of the copper alloy sheet is I{422}. If the I{200}/I{422} is too small, the properties of the recrystallized texture having {422} crystal plane as a principal orientation are relatively dominant, so that the bending workability of the copper alloy sheet is remarkably deteriorated. On the other hand, if the I{200}/I{422} is large, the bending workability of the copper alloy sheet in both of the LD and TD is remarkably improved. In addition, if the strength of the copper alloy sheet is enhanced to be a tensile strength of not less than 800 MPa, it is required to further improve the bending workability, so that the crystal orientation preferably satisfies I{200}/I{422}≥50.

[Mean Crystal Grain Size]

In general, if a metal sheet is bent, crystal grains are not uniformly deformed since there are crystal grains, which are easy to be deformed during bending, and crystal grains, which are difficult to be deformed during bending, due to the difference in crystal orientation of the crystal grains. With the increase of the extent of bending of the metal sheet, the crystal grains being easy to be deformed are preferentially deformed, and the ununiform deformation between crystal grains causes fine irregularities on the surface of the bent portion of the metal sheet. The irregularities are developed to wrinkles, and cause cracks (breaks) according to circumstances.

Therefore, the bending workability of the metal sheet depends on the crystal grain size and crystal orientation thereof. As the crystal grain size of the metal sheet is smaller, the bending deformation thereof is dispersed to improve the bending workability thereof. As the amount of crystal grains being easy to be deformed during bending is larger, the bending workability of the metal sheet is improved. That is, if the metal sheet has a specific texture, the bending workability thereof can be remarkably improved even if crystal grains are not particularly refined.

On the other hand, stress relaxation is a phenomenon which is caused by the diffusion of atoms. The diffusion rate along the grain boundaries of atoms is far higher than that in the grains, and the area of grain boundaries existing per a unit volume is increased as the crystal grain size is decreased, so that the fining of the crystal grains causes to promote stress relaxation. That is, great crystal grain sizes are generally advantageous in order to improve the stress relaxation resistance of the metal sheet.

As described above, although a smaller mean crystal grain size is advantageous in order to improve the bending workability of the metal sheet, the stress relaxation resistance is easy to deteriorate if the mean crystal grain size is too small. If the true mean crystal grain size D, which is obtained without including twin crystal boundaries while distinguishing crystal grain boundaries from the twin crystal boundaries on the surface of the copper alloy sheet by the method of section based on JIS H0501, is not less than 6 μm, and preferably not less than 8 μm, it is easy to ensure the stress relaxation resistance of the copper alloy sheet to such an extent that the copper alloy sheet can be satisfactorily used as the material of connectors for automobiles. However, if the mean crystal grain size D of the copper alloy sheet is too large, the surface of the bent portion of the copper alloy sheet is easy to be rough, so that there are some cases where the bending workability of the copper alloy sheet is deteriorated. Therefore, the mean crystal grain size D of the copper alloy sheet is preferably not greater than 60 μm. Thus, the mean crystal grain size D of the copper alloy sheet is preferably in the range of from 6 μm to 60 μm, and more preferably in the range of from 8 μm to 30 μm. Furthermore, the final mean crystal grain size D of the copper alloy sheet is roughly determined by crystal grain sizes after a solution treatment. Therefore, the mean crystal grain size D of the copper alloy sheet can be controlled by solution treatment conditions.

[Mean Twin Crystal Density]

Even if the crystal grain sizes are adjusted, it is difficult to solve the above-described trade-off relationship between the bending workability and stress relaxation resistance of the copper alloy sheet. In the preferred embodiment of a copper alloy sheet according to the present invention, the means crystal grain size D, which is obtained without including twin crystal boundaries while distinguishing crystal grain boundaries from the twin crystal boundaries on the surface of the copper alloy sheet by the method of section based on JIS H0501, is in the range of from 6 μm to 60 μm, and the mean twin crystal density $N_G=(D-D_T)/D_T$ is not less than 0.5, the mean twin crystal density being derived from the mean crystal grain size D, which is obtained without including twin crystal boundaries, and a mean crystal grain size $D_T$ which is obtained while including twin crystal boundaries without distinguishing crystal grain boundaries from the twin crystal boundaries on the surface of the copper alloy sheet by the method of section based on JIS H0501. Thus, both of the stress relaxation resistance and bending workability of the copper alloy sheet are remarkably improved.

Furthermore, the "twin crystal" means a pair of adjacent crystal grains, the crystal lattices of which have a mirror symmetric relation to each other with respect to a certain plane (a twin crystal boundary being typically the {111} plane). The most typical twin crystal in copper and copper alloys is a portion (twin crystal zone) between two parallel twin crystal boundaries in crystal grains. The twin crystal boundary is a grain boundary having the lowest grain boundary energy. The twin crystal boundary serves to sufficiently improve the bending workability of the copper alloy sheet as a grain boundary. On the other hand, the turbulence in atomic arrangement along the twin crystal boundary is smaller than that along the grain boundary. The twin crystal boundary has a compact structure. In the twin crystal boundary, it is difficult to carry out the diffusion of atoms, the segregation of impurities, and the formation of deposits, and it is difficult to break them along the twin crystal boundary. That is, a larger number of twin crystal boundaries are advantageous in order to improve the stress relaxation resistance and bending workability of the copper alloy sheet.

As described above, in the preferred embodiment of a copper alloy sheet according to the present invention, the mean twin crystal density $N_G=(D-D_T)/D_T$ per a crystal grain is preferably not less than 0.5, more preferably not less than 0.7, and most preferably not less than 1.0, the mean twin crystal density being derived from the mean crystal grain size $D_T$ which is obtained while including twin crystal boundaries without distinguishing crystal grain boundaries from the twin crystal boundaries on the surface of the copper alloy sheet by the method of section based on JIS H0501, and the mean crystal grain size D which is obtained without including twin crystal boundaries while distinguishing crystal grain boundaries from the twin crystal boundaries on the surface of the copper alloy sheet by the method of section based on JIS H0501. Furthermore, the mean crystal grain size $D_T$ obtained while including twin crystal boundaries is a mean crystal grain size measured assuming that a twin crystal is one grain boundary. For example, when $D=2D_T$, $N_G=1$ which means that one twin crystal exists in one crystal grain on average.

In Cu—Ni—Si copper alloys having a crystal structure of face centered cubic (fcc), most of twin crystals are generated during recrystallization to be annealing twin crystals. It was found that such annealing twin crystals depend on the existing state of alloy elements before the solution (recrystallization) treatment (any one of solid solution and deposit), and on solution treatment conditions. The final mean twin crystal density is roughly determined by the mean twin crystal density at a stage before the solution treatment. Therefore, the mean twin crystal density can be controlled by the process annealing conditions before the solution treatment and the solution treatment conditions.

[Characteristics]

In order to miniaturize and thin electric and electronic parts, such as connectors, the copper alloy sheet serving as the material thereof preferably has a tensile strength of not less than 700 MPa, and more preferably has a tensile strength of not less than 750 MPa. In order to enhance the strength of the copper alloy sheet by utilizing age hardening, the copper alloy sheet has a metallographic structure treated by ageing. With respect to the bending workability in both of the good way and bad way, the ratio R/t of the minimum bending radius R to the thickness t of the copper alloy sheet in the 90° W bending test is preferably not higher than 1.0, and more preferably not higher than 0.5.

When the copper alloy sheet is used as the material of connectors for automobiles, the value in the TD with respect to the stress relaxation resistance is particularly important, so that the stress relaxation resistance is preferably evaluated by a stress relaxation rate obtained by using a test piece which is so cut that the TD is the longitudinal direction. The stress relaxation rate of the copper alloy sheet is preferably not higher than 6%, more preferably not higher than 5%, and most preferably not higher than 3%, after the copper alloy sheet is held at 150° C. for 1000 hours so that the maximum load stress on the surface of the copper alloy sheet is 80% of 0.2% yield strength.

[Producing Method]

The above-described copper alloy sheet can be produced by the preferred embodiment of a method for producing a copper alloy sheet according to the present invention. The preferred embodiment of a method for producing a copper alloy sheet according to the present invention comprises: a melting and casting step of melting and casting the raw materials of a copper alloy having the above-described composition; a hot rolling step of carrying out a hot rolling operation while lowering temperature in the range of from 950° C. to 400° C., after the melting and casting step; a first cold rolling step of carrying out a cold rolling operation at a rolling reduction of not less than 30%, after the hot rolling step; a process annealing step of carrying out a heat treatment for deposition at a heating temperature of 450 to 600° C., after the first cold rolling step; a second cold rolling step of carrying out a cold rolling operation at a rolling reduction of not less than 70%, after the process annealing step; a solution treatment step of carrying out a solution treatment at a heating temperature of 700 to 980° C., after the second cold rolling step; an intermediate cold rolling step of carrying out a cold rolling operation at a rolling reduction of 0 to 50% (the "rolling reduction of 0%" means that the intermediate cold rolling step is not carried out), after the solution treatment step; an ageing treatment step of carrying out an ageing treatment at a temperature of 400 to 600° C., after the intermediate cold rolling step; and a finish cold rolling step of carrying out a cold rolling operation at a rolling reduction of not higher than 50%, after the ageing treatment step. At the process annealing step, the heat treatment is carried out so as to cause a ratio Ea/Eb of an electric conductivity Ea after the process annealing to an electric conductivity Eb before the process annealing to be 1.5 or more while causing a ratio Ha/Hb of a Vickers hardness Ha after the process annealing to a Vickers hardness Hb before the process annealing to be 0.8 or less. Furthermore, after the finish cold rolling step, a heat treatment (a low temperature annealing operation) is preferably carried out at a temperature of 150 to 550° C. After the hot rolling operation, facing may be optionally carried out, and after each heat treatment, pickling, polishing and degreasing may be optionally carried out. These steps will be described below in detail.

(Melting and Casting)

By a similar method to typical methods for melting and casing copper alloys, the raw materials of a copper alloy are melted, and then, an ingot is produced by the continuous casting, semi-continuous casting or the like.

(Hot Rolling)

As the hot rolling for the ingot, a plurality of hot rolling passes may be carried out while lowering temperature in the range of from 950° C. to 400° C. Furthermore, at least one of the hot rolling passes is preferably carried out at a lower temperature than 600° C. The total rolling reduction may be about 80 to 95%. After the hot rolling is completed, rapid cooling is preferably carried out by water cooling or the like. After the hot working, facing and/or pickling may be optionally carried out.

(First Cold Rolling)

At the first cold rolling step, the rolling reduction is required to be 30% or less. However, if the rolling reduction in the first cold rolling is too high, the bending workability of a finally produced copper alloy sheet is deteriorated. Therefore, the rolling reduction in the first cold rolling is preferably in the range of from 30% to 95%, and more preferably in the range of from 70% to 90%. If the material worked at such a rolling reduction is subjected to a process annealing operation at the subsequent step, the amount of deposits can be increased.

(Process Annealing)

Then, the heat treatment at the process annealing step is carried out for depositing Ni, Si and so forth. In conventional methods for producing copper alloy sheets, the process annealing step is not carried out, or the process annealing step is carried out at a relatively high temperature so as to soften or re-crystallize the sheet in order to reduce the rolling load at the subsequent step. In either case, it is insufficient to enhance the density of annealing twin crystals in recrystallized grains after the subsequent solution treatment step and to form a recrystallized texture having the {200} crystal plane (Cube orientation) as a principal orientation component.

It was found that the generation of annealing twin crystals and crystal grains having the Cube orientation in the recrystallization process is influenced by the stacking fault energy of a parent phase immediately before recrystallization. It was also found that a lower stacking fault energy is easy to form annealing twin crystals and that a higher stacking fault energy is easy to generate crystal grains having the Cube orientation. It was found that, for example, among pure aluminum, pure copper and brass, the stacking fault energy is lower in that order, and the density of annealing twin crystals is higher in that order, but it is more difficult to generate crystal grains having the Cube orientation in that order. That is, in copper alloys having a stacking fault energy close to that of pure copper, there is every possibility that the densities of both of the annealing twin crystals and the Cube orientation are increased.

The stacking fault energy of Cu—Ni—Si alloys can be enhanced by decreasing the amount of solid solution of elements due to the deposition of Ni, Si and so forth at the process annealing step in order to enhance the densities of both of the annealing twin crystals and the Cube orientation. The process annealing is preferably carried out at a temperature of 450 to 600° C. If the process annealing is carried out at a temperature of about an overageing temperature for 1 to 20 hours, good results can be obtained.

If the annealing temperature is too low and/or if the annealing time is too short, the deposition of Ni, Si and so forth is insufficient, so that the amount of the solid solution of elements is increased (the recovery of the electric conductivity is insufficient). As a result, it is not possible to sufficiently enhance the stacking fault energy. On the other hand, if the annealing temperature is too high, the amount of alloy elements capable of being formed as a solid solution is increased, so that the amount of alloy elements capable of being deposited is decreased. As a result, even if the annealing time is increased, it is not possible to sufficiently deposit Ni, Si and so forth.

Specifically, at the process annealing step, the heat treatment is preferably carried out so as to cause the ratio Ea/Eb of the electric conductivity Ea after the process annealing to the electric conductivity Eb before the process annealing to be 1.5 or more while causing the ratio Ha/Hb of the Vickers hardness Ha after the process annealing to the Vickers hardness Hb before the process annealing to be 0.8 or less.

At the process annealing step, the copper alloy sheet is softened so that the Vickers hardness thereof is decreased to be 80% or less. Therefore, there is an advantage that the rolling load is reduced at the subsequent step.

(Second Cold Rolling)

Then, the second cold rolling operation is carried out. At the second cold rolling step, the rolling reduction is preferably not less than 70%, and more preferably not less than 80%. At the second cold rolling step, it is possible to efficiently feed strain energy by the presence of deposits at the previous step. If the strain energy falls short, there is some possibility that the grain sizes of recrystallized grains generated in the solution treatment may be ununiform. In addition, the texture having the {422} crystal plane as a principal orientation component is easy to remain, and the formation of recrystallized texture having the {200} crystal plane as a principal orientation component is insufficient. That is, the recrystallized texture depends on the dispersed state and amount of deposits before recrystallization, and on the rolling reduction in the cold rolling operation. Furthermore, the upper limit of the rolling reduction in the cold rolling operation is not particularly required to be limited. However, a stronger rolling operation may be carried out since the copper alloy sheet has been softened.

(Solution Treatment)

The solution treatment is a heat treatment for forming the solid solution of solute atoms into a matrix again and carrying out recrystallization. The solution treatment is carried out for forming annealing twin crystals having a higher density and for forming recrystallized texture having the {200} crystal plane as a principal orientation component.

The solution treatment is carried out at a temperature of 700 to 980° C. preferably for 10 seconds to 20 minutes, and more preferably for 10 seconds to 10 minutes. If the solution treatment temperature is too low, recrystallization is incomplete, and the solid solution of solute elements is also insufficient. In addition, there is a tendency for the density of annealing twin crystals to be decreased, and there is a tendency for crystals having the {422} crystal plane as a principal orientation component to easily remain, so that it is difficult to finally obtain a copper alloy sheet having an excellent bending workability and a high strength. On the other hand, if the solution treatment temperature is too high, crystal grains are coarsened, so that the bending workability of the sheet is easily deteriorated.

Specifically, the temperature (reacting temperature) and time (holding time) for carrying out the solution treatment are preferably set so that the mean crystal grain size D (obtained without including twin crystal boundaries while distinguishing crystal grain boundaries from the twin crystal boundaries on the surface of the copper alloy sheet) of recrystallized grains after the solution treatment is in the range of from 5 μm to 60 μm, and preferably in the range of from 5 μm to 40 μm.

If the recrystallized grains after the solution treatment are too fine, the density of annealing twin crystals is decreased, so that it is disadvantageous in order to improve the stress relaxation resistance of the copper alloy sheet. On the other hand, if the recrystallized grains are too coarse, the surface of the bent portion of the copper alloy sheet is easy to be rough. The grain sizes of the recrystallized grains vary in accordance with the cold rolling reduction before the solution treatment and the chemical composition. However, if the relationship between the heat pattern in the solution treatment and the mean crystal grain size is previously obtained by experiments with respect to each of the compositions of copper alloys, it is possible to set the holding time and reaching temperature in the temperature range of from 700° C. to 980° C.

(Intermediate Cold Rolling)

Then, the intermediate cold rolling operation is carried out. The cold rolling at this stage has the function of promoting deposition in the subsequent ageing treatment, and can shorten the ageing time for providing necessary characteristics, such as electric conductivity and hardness. By the intermediate cold rolling operation, the texture having the {220} crystal plane as a principal orientation component is developed. However, if the rolling reduction is not higher than 50%, there sufficiently remain crystal grains which have the {220} crystal plane parallel to the surface of the sheet. In particular, the intermediate cold rolling operation contributes to the improvement of the final strength and bending workability of the sheet if the rolling reduction in the intermediate cold rolling operation is appropriately combined with the rolling reduction in the finish cold rolling carried out after the ageing treatment. The cold rolling at this stage is required to be carried out at a rolling reduction of not higher than 50%, and is preferably carried out at a rolling reduction of 0 to 35%. If the rolling reduction is too high, deposition is ununiformly generated at the subsequent ageing treatment step, so that overageing is easily caused, and it is difficult to obtain a crystal orientation satisfying I{200}/I{422}≥15.

Furthermore, the "rolling reduction of 0%" means that the ageing treatment is directly carried out without carrying out the intermediate cold rolling after the solution treatment. The cold rolling at this stage may be omitted in order to improve the productivity of the copper alloy sheet.

(Ageing Treatment)

Then, the ageing treatment is carried out. The temperature in the ageing treatment is set so as not to be too high on effective conditions for improving the electric conductivity and strength of Cu—Ni—Si alloy sheets. If the ageing temperature is too high, the crystal orientation having the {200} crystal plane, which is developed by the solution treatment, as a preferred orientation is weakened, and the characteristics of the {422} crystal plane strongly appear, so that there are some cases where it is not possible to obtain the function of sufficiently improving the bending workability of the copper alloy sheet. On the other hand, if the ageing temperature is too low, it is not possible to sufficiently obtain the function of improving the above-described characteristics, or the ageing time is too long, so that it is disadvantageous to productivity. Specifically, the ageing treatment is preferably carried out at a temperature of 400 to 600° C. If the ageing treatment time is about 1 to 10 hours, good results can be obtained.

(Finish Cold Rolling)

The finish cold rolling has the function of improving the strength level of the copper alloy sheet and of developing the rolled texture having the {220} crystal plane as a principal orientation component. If the rolling reduction in the finish cold rolling is too low, it is not possible to sufficiently obtain the function of improving the strength of the sheet. On the other hand, if the rolling reduction in the finish cold rolling is too high, the rolling texture having the {220} as the principal orientation component is too superior to other orientations, so that it is not possible to realize an intermediate crystal orientation having both of a high strength and an excellent bending workability.

The rolling reduction in the finish cold rolling is preferably not less than 10%. However, the upper limit of the rolling reduction in the finish cold rolling must be determined in consideration of the contributory shares of the intermediate cold rolling carried out before the ageing treatment. It was found that the upper limit of the rolling reduction in the finish cold rolling is required to be set so that the total decreasing rate of the thickness of the sheet from the solution treatment to the final step does not exceed 50% by the total of the rolling reductions in the finish cold rolling and the above-described intermediate cold rolling. That is, the finish cold rolling operation is preferably carried out so as to satisfy $10 \leq \varepsilon 2 \leq \{(50-\varepsilon 1)/(100-\varepsilon 1)\} \times 100$, assuming that the rolling reduction (%) in the intermediate cold rolling is $\varepsilon 1$ and the rolling reduction (%) in the finish cold rolling is $\varepsilon 2$.

The final thickness of the sheet is preferably in the range of from about 0.05 mm to about 1.0 mm, and more preferably in the range of from 0.08 mm to 0.5 mm.

(Low Temperature Annealing)

After the finish cold rolling, the low temperature annealing may be carried out in order to reduce the residual stress in the copper alloy sheet and to improve the spring limit value and stress relaxation resistance of the sheet. The heating temperature is preferably set to be in the range of from 150° C. to 550° C. By the low temperature annealing, it is possible to reduce the residual stress in the copper alloy sheet and to improve the bending workability of the copper alloy sheet while hardly decreasing the strength thereof. The low temperature annealing also has the function of improving the electric conductivity of the copper alloy sheet. If the heating temperature is too high, the copper alloy sheet is softened in a short time, so that variations in characteristics are easily caused in either of batch and continuous systems. On the other hand, if the heating temperature is too low, it is not possible to sufficiently obtain the function of improving the above-described characteristics. The heating time is preferably not less than 5 seconds. If the heating time is not longer than 1 hour, good results can be usually obtained.

The examples of copper alloy sheets and methods for producing the same according to the present invention will be described below in detail.

Examples 1-19

There were melted a copper alloy containing 1.65 wt % of Ni, 0.40 wt % of Si and the balance being Cu (Example 1), a copper alloy containing 1.64 wt % of Ni, 0.39 wt % of Si, 0.54 wt % of Sn, 0.44 wt % of Zn and the balance being Cu (Example 2), a copper alloy containing 1.59 wt % of Ni, 0.37 wt % of Si, 0.48 wt % of Sn, 0.18 wt % of Zn, 0.25 wt % of Fe and the balance being Cu (Example 3), a copper alloy containing 1.52 wt % of Ni, 0.61 wt % of Si, 1.1 wt % of Co and the balance being Cu (Example 4), a copper alloy containing 0.77 wt % of Ni, 0.20 wt % of Si and the balance being Cu (Example 5), 3.48 wt % of Ni, 0.70 wt % of Si and the balance being Cu (Example 6), a copper alloy containing 2.50 wt % of Ni, 0.49 wt % of Si, 0.19 wt % of Mg and the balance being Cu (Example 7), a copper alloy containing 2.64 wt % of Ni, 0.63 wt % of Si, 0.13 wt % of Cr, 0.10 wt % of P and the balance being Cu (Example 8), a copper alloy containing 2.44 wt % of Ni, 0.46 wt % of Si, 0.11 wt % of Sn, 0.12 wt % of Ti, 0.007 wt % of B and the balance being Cu (Example 9), a copper alloy containing 1.31 wt % of Ni, 0.36 wt % of Si, 0.12 wt % of Zr, 0.07 wt % of Mn and the balance being Cu (Example 10), a copper alloy containing 1.64 wt % of Ni, 0.39 wt % of Si, 0.54 wt % of Sn, 0.44 wt % of Zn and the balance being Cu (Example 11), a copper alloy containing 1.65 wt % of Ni, 0.40 wt % of Si, 0.57 wt % of Sn, 0.52 wt % of Zn and the balance being Cu (Example 12), a copper alloy containing 3.98 wt % of Ni, 0.98 wt % of Si, 0.10 wt % of Ag, 0.11 wt % of Be and the balance being Cu (Example 13), a copper alloy containing 3.96 wt % of Ni, 0.92 wt % of Si, 0.21 wt % of misch metal and the balance being Cu (Example 14), and copper alloys, each of which contains 1.52 wt % of Ni, 0.61 wt % of Si, 1.1 wt % of Co and the balance being Cu (Examples 15-19), respectively. Then, a vertical continuous casting machine was used for casting the melted copper alloys to obtain ingots, respectively.

Each of the ingots was heated to 950° C., and then, hot-rolled while lowering the temperature thereof from 950° C. to 400° C., so that a copper alloy sheet having a thickness of 10 mm was obtained. Thereafter, the obtained sheet was rapidly cooled with water, and then, the surface oxide layer was removed (faced) by mechanical polishing. Furthermore, the hot rolling was carried out by a plurality of hot rolling passes, and at least one of the hot rolling passes was carried at a lower temperature than 600° C.

Then, a first cold rolling operation was carried out at a rolling reduction of 86% (Examples 1, 5-10 and 12-14), 80% (Examples 2 and 3), 82% (Example 4), 72% (Example 11), 46% (Example 15), 90% (Example 16), 30% (Example 17), 95% (Example 18) and 97% (Example 19), respectively.

Then, a process annealing operation was carried out at 520° C. for 6 hours (Examples 1, 2 and 5-14), at 540° C. for 6 hours (Example 3), at 550° C. for 8 hours (Example 4), at 550° C. for 8 hours (Examples 15, 16, 18 and 19), and at 600° C. for 8 hours (Example 17), respectively. In each of the examples, the electric conductivities Eb and Ea of each of the copper alloy sheets before and after the process annealing were measured, and the ratio Ea/Eb of the electric conductivity Ea after the process annealing to the electric conductivity Eb before the process annealing was obtained. As a result, the ratio Ea/Eb was 2.1 (Example 1), 1.9 (Example 2), 1.8 (Example 3), 2.0 (Example 4), 1.6 (Example 5), 2.2 (Example 6), 1.9 (Example 7), 2.0 (Example 8), 2.2 (Example 9), 1.7 (Example 10), 2.0 (Example 11), 1.9 (Example 12), 2.4 (Example 13), 2.3 (Example 14), 1.8 (Example 15), 1.9 (Example 16), 1.7 (Example 17), 2.0 (Example 18) and 2.0 (Example 19), respectively. Thus, all of the ratios Ea/Eb were not less than 1.5. In addition, the Vickers hardnesses Hb and Ha of each of the copper alloy sheets before and after the process annealing were measured, and the ratio Ha/Hb of the Vickers hardness Ha after the process annealing to the Vickers hardness Hb before the process annealing was obtained. As a result, the ratio Ha/Hb was 0.55 (Example 1), 0.52 (Example 2), 0.53 (Example 3), 0.62 (Example 4), 0.58 (Example 5), 0.46 (Example 6), 0.50 (Example 7), 0.54 (Example 8), 0.29 (Example 9), 0.72 (Example 10), 0.58 (Example 11), 0.51 (Example 12), 0.44 (Example 13), 0.46 (Example 14), 0.70 (Examples 15 and 16) and 0.60 (Examples 17-19), respectively. Thus, all of the ratios Ha/Hb were not higher than 0.8.

Thereafter, a second cold rolling operation was carried out at a rolling reduction of 86% (Examples 1, 5-10 and 12-14), 90% (Examples 2, 3 and 16), 89% (Example 4), 76% (Example 11), 98% (Example 15), 99% (Example 17), 79% (Example 18) and 70% (Example 19), respectively.

Then, a solution treatment was carried out by holding the sheet at a temperature, which was controlled in the range of from 700° C. to 980° C. in accordance with the composition of the copper alloy, for 10 seconds to 10 minutes so that a mean crystal grain size (corresponding to a true mean crystal grain size D obtained without including twin crystal boundaries by the method of section based on JIS H0501) on the surface of the rolled sheet was greater than 5 μm and not greater than 30 μm. The optimum holding temperature and holding time in the solution treatment were previously obtained in accordance with the composition of the copper alloy in each of the examples by preliminary experiments. The holding temperature and the holding time were 750° C. and 10 minutes in Example 1, 725° C. and 10 minutes in Example 2, 775° C. and 10 minutes in Example 3, 900° C. and 10 minutes in Example 4, 700° C. and 7 minutes in Example 5, 850° C. and 10 minutes in Examples 6, 13 and 14, 800° C. and 10 minutes in Examples 7-9, 700° C. and 10 minutes in Example 10, 725° C. and 10 minutes in Examples 11 and 12, 940° C. and 1 minute in Examples 15 and 16, 980° C. and 1 minute in Example 17, and 950° C. and 1 minute in Examples 18 and 19, respectively.

Then, an intermediate cold rolling operation was carried out at a rolling reduction of 12% in Example 12. This intermediate cold rolling operation was not carried out in other examples.

Then, an ageing treatment was carried out at 450° C. in Examples 1-14, and at 475° C. in Examples 15-19. The ageing treatment time was adjusted in accordance with the chemical composition of the copper alloy so that the hardness of the sheet was maximum at the ageing treatment temperature of 450° C. or 475° C. Furthermore, the optimum ageing treatment time was previously obtained in accordance with the composition of the copper alloy in each of the examples by preliminary experiments. The ageing treatment time was 5 hours in Examples 1-3 and 10-12, 7 hours in Examples 4 and 5, 4 hours in Examples 6-9, 13 and 14, and 7 hours in Examples 15-19, respectively.

Then, a finish cold rolling operation was carried out at a rolling reduction of 29% (Examples 1-10, 13 and 14), 40% (Example 11), 17% (Example 12) and 33% (Examples 15-19), respectively. Then, a low temperature annealing operation was carried out at 425° C. for one minute to obtain a copper alloy sheet in each of Examples 1-19. Furthermore, facing was optionally carried out in the middle of the production of the sheets so that the thickness of each sheet was 0.15 mm.

Then, samples were cut out from the copper alloy sheets obtained in these examples, to examine the mean crystal grain size, mean twin crystal density, intensity of X-ray diffraction, electric conductivity, tensile strength, bending workability, and stress relaxation resistance of each sheet as follows.

First, the surface of each of the obtained samples of the copper alloy sheets was polished, etched, and observed by an optical microscope to obtain a mean crystal grain size (a mean crystal grain size obtained while including twin crystal boundaries) $D_T$ without distinguishing crystal grain boundaries from the twin crystal boundaries by the method of section based on JIS H0501. As a result, the mean crystal grain size $D_T$ was 5.2 μm (Example 1), 3.8 μm (Example 2), 4.5 μm (Example 3), 4.5 μm (Example 4), 7.1 μm (Example 5), 4.4 μm (Example 6), 6.4 μm (Example 7), 6.0 μm (Example 8), 5.8 μm (Example 9), 5.3 μm (Example 10), 9.0 μm (Example 11), 9.2 μm (Example 12), 4.7 μm (Example 13), 4.7 μm (Example 14), 5.7 μm (Example 15), 4.8 μm (Example 16), 6.4 μm (Example 17), 5.2 μm (Example 18) and 6.7 μm (Example 19), respectively.

In addition, a mean crystal grain size (a true mean crystal grain size obtained without including twin crystal boundaries) D while distinguishing crystal grain boundaries from the twin crystal boundaries by the method of section based on JIS H0501 was obtained. As a result, the mean crystal grain size D was 12 μm (Example 1), 8 μm (Example 2), 10 μm (Example 3), 9 μm (Example 4), 15 μm (Example 5), 8 μm (Example 6), 14 μm (Example 7), 12 μm (Example 8), 11 μm (Example 9), 10 μm (Example 10), 18 μm (Example 11), 24 μm (Example 12), 8 μm (Example 13), 9 μm (Example 14), 12 μm (Example 15), 12 μm (Example 16), 14 μm (Example 17), 12 μm (Example 18) and 10 μm (Example 19), respectively.

Then, a mean twin crystal density $N_G=(D-D_T)/D_T$ was calculated. As a result, the mean twin crystal density was 1.3 (Example 1), 1.1 (Example 2), 1.2 (Example 3), 1.0 (Example 4), 1.1 (Example 5), 0.8 (Example 6), 1.2 (Example 7), 1.0 (Example 8), 0.9 (Example 9), 0.9 (Example 10), 1.0 (Example 11), 1.5 (Example 12), 0.7 (Example 13), 0.9 (Example 14), 1.1 (Example 15), 1.5 (Example 16), 1.2

(Example 17), 1.3 (Example 18) and 0.5 (Example 19), respectively. In all of the examples, $N_G=(D-D_T)/D_T \geq 0.5$ was satisfied.

With respect to the measurement of the intensity of X-ray diffraction (the integrated intensity of X-ray diffraction), the integrated intensity I{200} at the diffraction peak on the {200} plane and the integrated intensity I{422} at the diffraction peak on the {422} plane on the surface (rolled surface) of each of the samples were measured by means of an X-ray diffractometer (XRD) on the measuring conditions which contain Mo-Kα1 and Kα2 rays, a tube voltage of 40 kV and a tube current of 30 mA. Similarly, the intensity $I_0\{200\}$ of X-ray diffraction on the {220} plane of the standard powder of pure copper was also measured by means of the same X-ray diffractometer on the same measuring conditions. Furthermore, the rolled surface of the used samples was previously washed with an acid or finish-polished with a #1500 waterproof paper if oxidation was clearly observed on the rolled surface of the samples. As a result, the ratio $I\{200\}/I_0\{200\}$ of the intensities of X-ray diffraction was 3.2 (Example 1), 3.0 (Example 2), 2.9 (Example 3), 3.8 (Example 4), 3.3 (Example 5), 3.5 (Example 6), 3.1 (Example 7), 3.2 (Example 8), 3.4 (Example 9), 3.0 (Example 10), 2.2 (Example 11), 4.2 (Example 12), 3.3 (Example 13), 3.1 (Example 14), 3.9 (Example 15), 4.0 (Example 16), 4.1 (Example 17), 3.9 (Example 18) and 1.9 (Example 19), respectively. All of the examples has a crystal orientation satisfying $I\{200\}/I_0\{200\} \geq 1.0$. The ratio I{200}/I{422} of the intensities of X-ray diffraction was 37 (Example 1), 20 (Example 2), 16 (Example 3), 52 (Example 4), 16 (Example 5), 50 (Example 6), 25 (Example 7), 27 (Example 8), 24 (Example 9), 18 (Example 10), 19 (Example 11), 38 (Example 12), 56 (Example 13), 55 (Example 14), 35 (Example 15), 46 (Example 16), 32 (Example 17), 44 (Example 18) and 18 (Example 19), respectively. All of the examples has a crystal orientation satisfying $I\{200\}/I\{422\} \geq 15$.

The electric conductivity of the copper alloy sheet was measured in accordance with the electric conductivity measuring method based on JIS H0505. As a result, the electric conductivity was 43.1% IACS (Example 1), 40.0% IACS (Example 2), 39.4% IACS (Example 3), 54.7% IACS (Example 4), 52.2% IACS (Example 5), 43.2% IACS (Example 6), 45.1% IACS (Example 7), 43.9% IACS (Example 8), 41.9% IACS (Example 9), 55.1% IACS (Example 10), 43.0% IACS (Example 11), 44.0% IACS (Example 12), 42.7% IACS (Example 13), 40.1% IACS (Example 14), 40.0% IACS (Example 15), 39.0% IACS (Example 16), 40.0% IACS (Example 17), 42.0% IACS (Example 18) and 42.0% IACS (Example 19), respectively.

In order to evaluate the tensile strength of the copper alloy sheet, three test pieces (No. 5 test pieces based on JIS Z2201) for tension test in the LD (rolling direction) were cut out from each of the sheets of copper alloys. Then, the tension test based on JIS Z2241 was carried out with respect to each of the test pieces to derive the mean value of tensile strengths. As a result, the tensile strength was 722 MPa (Example 1), 720 MPa (Example 2), 701 MPa (Example 3), 820 MPa (Example 4), 702 MPa (Example 5), 851 MPa (Example 6), 728 MPa (Example 7), 765 MPa (Example 8), 762 MPa (Example 9), 714 MPa (Example 10), 730 MPa (Example 11), 715 MPa (Example 12), 852 MPa (Example 13), 865 MPa (Example 14), 878 MPa (Example 15), 852 MPa (Example 16), 898 MPa (Example 17), 894 MPa (Example 18) and 847 MPa (Example 19), respectively. All of the copper alloy sheets have a high strength of not less than 700 MPa.

In order to evaluate the bending workability of the copper alloy sheet, three bending test pieces (width: 10 mm) having a longitudinal direction of LD (rolling direction), and three bending test pieces (width: 10 mm) having a longitudinal direction of TD (the direction perpendicular to the rolling direction and thickness direction) were cut out from the copper alloy sheet, respectively. Then, the 90° W bending test based on JIS H3110 was carried out with respect to each of the test pieces. Then, the surface and section of the bent portion of each test piece after the test were observed at a magnification of 100 by means of an optical microscope, to derive a minimum bending radius Rat which cracks are not produced. Then, the minimum bending radius R was divided by the thickness t of the copper alloy sheet, to derive the values of R/t in the LD and TD, respectively. The worst result of the values of R/t with respect to the three test pieces in each of the LD and TD was adopted as the value of R/t in the LD and TD, respectively. As a result, in Examples 1-12, 15 and 16, R/t was 0.0 in both of the bad way bending in which the bending axis of the sheet was the LD, and the good way bending in which the bending axis of the sheet was the TD, so that the bending workability of the sheet was excellent. In Examples 13 and 14, R/t was 0.0 in the good way bending, and R/t was 0.3 in the bad way bending. In Example 17, R/t was 0.5 in the good way bending, and R/t was 0.5 in the bad way bending. In Example 18, R/t was 0.0 in the good way bending, and R/t was 0.5 in the bad way bending. In Example 19, R/t was 1.0 in the good way bending, and R/t was 1.0 in the bad way bending.

In order to evaluate the stress relaxation resistance of the copper alloy sheet, a bending test piece (width: 10 mm) having a longitudinal direction of TD (the direction perpendicular to the rolling direction and thickness direction) was cut out from the copper alloy sheet. Then, the bending test piece was bent in the form of an arch so that the surface stress in the central portion of the test piece in the longitudinal direction thereof was 80% of the 0.2% yield strength, and then, the test piece was fixed in this state. Furthermore, the surface stress is defined by surface stress (MPa)=$6Et\delta/L_0^2$ wherein E denotes the modulus of elasticity (MPa) of the test piece, and t denotes the thickness (mm) of the test piece, δ denoting the deflection height (mm) of the test piece. After the test piece bent in the form of the arch was held at 150° C. for 1000 hours in the atmosphere, the stress relaxation rate was calculated from the bending deformation of the test piece to evaluate the stress relaxation resistance of the copper alloy sheet. Furthermore, the stress relaxation rate is calculated from stress relaxation rate (%)=$(L_1-L_2)\times 100/(L_1-L_0)$ wherein $L_0$ denotes the horizontal distance (mm) between both ends of the test piece fixed in the state that it is bent in the form of the arch, and $L_1$ denotes the length (mm) of the test piece before the test piece is bent, $L_2$ denoting the horizontal distance (mm) between both ends of the test piece after the test piece is bent and heated in the form of the arch. As a result, the stress relaxation rate was 4.1% (Example 1), 3.8% (Example 2), 3.6% (Example 3), 2.9% (Example 4), 3.2% (Example 5), 3.4% (Example 6), 3.3% (Example 7), 3.8% (Example 8), 3.0% (Example 9), 3.2% (Example 10), 4.5% (Example 11), 2.3% (Example 12), 2.7% (Example 13), 2.8% (Example 14), 3.8% (Example 15), 3.2% (Example 16), 3.4% (Example 17), 3.5% (Example 18) and 6.0% (Example 19), respectively. All of the copper alloy sheets have a stress relaxation rate of not higher than 6%. It is evaluated that such a copper alloy sheet having a stress relaxation rate of not higher than 6% has an excellent stress relaxation resistance and has a high durability even if the sheet is used as the material of connectors for automobiles.

Comparative Example 1

A copper alloy having the same chemical composition as that in Example 1 was used for obtaining a copper alloy sheet by the same method as that in Example 1, except that the first cold rolling operation was not carried out, that the heat treatment was carried out at 900° C. for one hour and that the rolling reduction in the second cold rolling operation was 98%.

Samples were cut out from the copper alloy sheet thus obtained, to examine the mean crystal grain size, mean twin crystal density, intensity of X-ray diffraction, electric conductivity, tensile strength, bending workability, and stress relaxation resistance of the sheet by the same methods as those in Examples 1-19.

As a result, the mean crystal grain size $D_T$ obtained while including twin crystal boundaries was 7.7 μm, and the true mean crystal grain size D obtained without including twin crystal boundaries was 10 μm, so that the mean twin crystal density $N_G$ was 0.3. In addition, $I\{200\}/I_0\{200\}$ was 0.5, and $I\{200\}/I\{422\}$ was 2.5. The electric conductivity was 43.4% IACS, and the tensile strength was 733 MPa. Moreover, R/t was 0.3 in the good way bending, and R/t was 1.3 in the bad way bending. The stress relaxation rate was 6.2%.

Comparative Example 2

A copper alloy having the same chemical composition as that in Example 2 was used for obtaining a copper alloy sheet by the same method as that in Example 2, except that the rolling reduction in the first cold rolling operation was 86%, that the heat treatment was carried out at 900° C. for one hour and that the rolling reduction in the second cold rolling operation was 86%.

Samples were cut out from the copper alloy sheet thus obtained, to examine the mean crystal grain size, mean twin crystal density, intensity of X-ray diffraction, electric conductivity, tensile strength, bending workability, and stress relaxation resistance of the sheet by the same methods as those in Examples 1-19.

As a result, the mean crystal grain size $D_T$ obtained while including twin crystal boundaries was 5.8 μm, and the true mean crystal grain size D obtained without including twin crystal boundaries was 7 μm, so that the mean twin crystal density $N_G$ was 0.2. In addition, $I\{200\}/I_0\{200\}$ was 0.4, and $I\{200\}/I\{422\}$ was 5.4. The electric conductivity was 40.1% IACS, and the tensile strength was 713 MPa. Moreover, R/t was 0.3 in the good way bending, and R/t was 1.3 in the bad way bending. The stress relaxation rate was 6.0%.

Comparative Example 3

A copper alloy having the same chemical composition as that in Example 3 was used for obtaining a copper alloy sheet by the same method as that in Example 3, except that the first cold rolling operation and heat treatment were not carried out, that the process annealing operation was not carried out and that the rolling reduction in the second cold rolling operation was 98%.

Samples were cut out from the copper alloy sheet thus obtained, to examine the mean crystal grain size, mean twin crystal density, intensity of X-ray diffraction, electric conductivity, tensile strength, bending workability, and stress relaxation resistance of the sheet by the same methods as those in Examples 1-19.

As a result, the mean crystal grain size $D_T$ obtained while including twin crystal boundaries was 6.4 μm, and the true mean crystal grain size D obtained without including twin crystal boundaries was 9 μm, so that the mean twin crystal density $N_G$ was 0.4. In addition, $I\{200\}/I_0\{200\}$ was 0.2, and $I\{200\}/I\{422\}$ was 6.2. The electric conductivity was 39.1% IACS, and the tensile strength was 691 MPa. Moreover, R/t was 0.7 in the good way bending, and R/t was 1.3 in the bad way bending. The stress relaxation rate was 5.8%.

Comparative Example 4

A copper alloy substantially having the same chemical composition as that in Example 4 (a copper alloy containing 1.54 wt % of Ni, 0.62 wt % of Si, 1.1 wt % of Co and the balance being Cu) was used for obtaining a copper alloy sheet by the same method as that in Example 4, except that the first cold rolling operation was not carried out, that the heat treatment was carried out at 550° C. for one hour, that the rolling reduction in the second cold rolling operation was 96% and that the rolling reduction in the finish cold rolling operation was 65%.

Samples were cut out from the copper alloy sheet thus obtained, to examine the mean crystal grain size, mean twin crystal density, intensity of X-ray diffraction, electric conductivity, tensile strength, bending workability, and stress relaxation resistance of the sheet by the same methods as those in Examples 1-19.

As a result, the mean crystal grain size $D_T$ obtained while including twin crystal boundaries was 6.2 μm, and the true mean crystal grain size D obtained without including twin crystal boundaries was 8 μm, so that the mean twin crystal density $N_G$ was 0.3. In addition, $I\{200\}/I_0\{200\}$ was 0.3, and $I\{200\}/I\{422\}$ was 10. The electric conductivity was 57.5% IACS, and the tensile strength was 889 MPa. Moreover, R/t was 2.0 in the good way bending, and R/t was 3.0 in the bad way bending. The stress relaxation rate was 7.2%.

Comparative Example 5

A copper alloy containing 0.46 wt % of Ni, 0.13 wt % of Si, 0.16 wt % of Mg and the balance being Cu was used for obtaining a copper alloy sheet by the same method as that in Example 1, except that the solution treatment was carried out at 600° C. for 10 minutes.

Samples were cut out from the copper alloy sheet thus obtained, to examine the mean crystal grain size, mean twin crystal density, intensity of X-ray diffraction, electric conductivity, tensile strength, bending workability, and stress relaxation resistance of the sheet by the same methods as those in Examples 1-19.

As a result, the mean crystal grain size $D_T$ obtained while including twin crystal boundaries was 2.1 μm, and the true mean crystal grain size D obtained without including twin crystal boundaries was 3 μm, so that the mean twin crystal density $N_G$ was 0.4. In addition, I{200}/$I_0${200} was 0.1, and I{200}/I{422} was 1.9. The electric conductivity was 55.7% IACS, and the tensile strength was 577 MPa. Moreover, R/t was 0.0 in the good way bending, and R/t was 0.0 in the bad way bending. The stress relaxation rate was 7.5%.

Comparative Example 6

A copper alloy containing 5.20 wt % of Ni, 1.20 wt % of Si, 0.51 wt % of Sn, 0.46 wt % of Zn and the balance being Cu was used for obtaining a copper alloy sheet by the same method as that in Example 1, except that the solution treatment was carried out at 925° C. for 10 minutes and that the ageing treatment was carried out at 450° C. for 7 hours.

Samples were cut out from the copper alloy sheet thus obtained, to examine the mean crystal grain size, mean twin crystal density, intensity of X-ray diffraction, electric conductivity, tensile strength, bending workability, and stress relaxation resistance of the sheet by the same methods as those in Examples 1-19.

As a result, the mean crystal grain size $D_T$ obtained while including twin crystal boundaries was 6.3 μm, and the true mean crystal grain size D obtained without including twin crystal boundaries was 12 μm, so that the mean twin crystal density $N_G$ was 0.9. In addition, I{200}/$I_0${200} was 2.1, and I{200}/I{422} was 13. The electric conductivity was 36.7% IACS, and the tensile strength was 871 MPa. Moreover, R/t was 1.0 in the good way bending, and R/t was 3.3 in the bad way bending. The stress relaxation rate was 3.6%.

The chemical compositions and producing conditions of the copper alloy sheets in the examples and comparative examples are shown in Tables 1 and 2, respectively. The ratios of electric conductivity and ratios of Vickers hardness before and after the process annealing during the production of the copper alloy sheets in the examples and comparative examples are shown in Table 3, and the results with respect to structures and characteristics thereof are shown in Table 4.

TABLE 1

| | Chemical Composition (wt %) | | | | |
|---|---|---|---|---|---|
| | Cu | Ni | Si | Sn | others |
| Ex. 1 | bal. | 1.65 | 0.40 | — | — |
| Ex. 2 | bal. | 1.64 | 0.39 | 0.54 | Zn: 0.44 |
| Ex. 3 | bal. | 1.59 | 0.37 | 0.48 | Zn: 0.18, Fe: 0.25 |
| Ex. 4 | bal. | 1.52 | 0.61 | — | Co: 1.1 |
| Ex. 5 | bal. | 0.77 | 0.20 | — | — |
| Ex. 6 | bal. | 3.48 | 0.70 | — | — |
| Ex. 7 | bal. | 2.50 | 0.49 | — | Mg: 0.19 |
| Ex. 8 | bal. | 2.64 | 0.63 | — | Cr: 0.13, P: 0.10 |
| Ex. 9 | bal. | 2.44 | 0.46 | 0.11 | Ti: 0.12, B: 0.007 |
| Ex. 10 | bal. | 1.31 | 0.36 | — | Zr: 0.12, Mn: 0.07 |
| Ex. 11 | bal. | 1.64 | 0.39 | 0.54 | Zn: 0.44 |
| Ex. 12 | bal. | 1.65 | 0.40 | 0.57 | Zn: 0.52 |
| Ex. 13 | bal. | 3.98 | 0.98 | — | Ag: 0.10, Be: 0.11 |
| Ex. 14 | bal. | 3.96 | 0.92 | — | misch metal: 0.21 |
| Ex. 15 | bal. | 1.52 | 0.61 | — | Co: 1.1 |
| Ex. 16 | bal. | 1.52 | 0.61 | — | Co: 1.1 |
| Ex. 17 | bal. | 1.52 | 0.61 | — | Co: 1.1 |
| Ex. 18 | bal. | 1.52 | 0.61 | — | Co: 1.1 |
| Ex. 19 | bal. | 1.52 | 0.61 | — | Co: 1.1 |
| Comp. 1 | bal. | 1.65 | 0.40 | — | — |
| Comp. 2 | bal. | 1.64 | 0.39 | 0.54 | Zn: 0.44 |
| Comp. 3 | bal. | 1.59 | 0.37 | 0.48 | Zn: 0.18, Fe: 0.25 |
| Comp. 4 | bal. | 1.54 | 0.62 | — | Co: 1.1 |
| Comp. 5 | bal. | 0.46 | 0.13 | — | Mg: 0.16 |
| Comp. 6 | bal. | 5.20 | 1.20 | 0.51 | Zn: 0.46 |

TABLE 2

| | Manufacturing Conditions | | | | | |
|---|---|---|---|---|---|---|
| | First Cold-rolling Reduction (%) | Process Annealing | Second Cold-rolling Reduction (%) | Solution Treatment | Ageing Treatment | Finishing Cold-rolling Reduction (%) |
| Ex. 1 | 86 | 520° C. × 6 h | 86 | 750° C. × 10 min | 450° C. × 5 h | 29 |
| Ex. 2 | 80 | 520° C. × 6 h | 90 | 725° C. × 10 min | 450° C. × 5 h | 29 |
| Ex. 3 | 80 | 540° C. × 6 h | 90 | 775° C. × 10 min | 450° C. × 5 h | 29 |
| Ex. 4 | 82 | 550° C. × 8 h | 89 | 900° C. × 10 min | 450° C. × 7 h | 29 |
| Ex. 5 | 86 | 520° C. × 6 h | 86 | 700° C. × 7 min | 450° C. × 7 h | 29 |
| Ex. 6 | 86 | 520° C. × 6 h | 86 | 850° C. × 10 min | 450° C. × 4 h | 29 |
| Ex. 7 | 86 | 520° C. × 6 h | 86 | 800° C. × 10 min | 450° C. × 4 h | 29 |
| Ex. 8 | 86 | 520° C. × 6 h | 86 | 800° C. × 10 min | 450° C. × 4 h | 29 |
| Ex. 9 | 86 | 520° C. × 6 h | 86 | 800° C. × 10 min | 450° C. × 4 h | 29 |
| Ex. 10 | 86 | 520° C. × 6 h | 86 | 700° C. × 10 min | 450° C. × 5 h | 29 |
| Ex. 11 | 72 | 520° C. × 6 h | 76 | 725° C. × 10 min | 450° C. × 5 h | 40 |
| Ex. 12 | 86 | 520° C. × 6 h | 86 | 725° C. × 10 min | 450° C. × 5 h | 17 |
| Ex. 13 | 86 | 520° C. × 6 h | 86 | 850° C. × 10 min | 450° C. × 4 h | 29 |
| Ex. 14 | 86 | 520° C. × 6 h | 86 | 850° C. × 10 min | 450° C. × 4 h | 29 |
| Ex. 15 | 46 | 550° C. × 8 h | 98 | 940° C. × 1 min | 475° C. × 7 h | 33 |
| Ex. 16 | 90 | 550° C. × 8 h | 90 | 940° C. × 1 min | 475° C. × 7 h | 33 |
| Ex. 17 | 30 | 600° C. × 8 h | 99 | 980° C. × 1 min | 475° C. × 7 h | 33 |
| Ex. 18 | 95 | 550° C. × 8 h | 79 | 950° C. × 1 min | 475° C. × 7 h | 33 |
| Ex. 19 | 97 | 550° C. × 8 h | 70 | 950° C. × 1 min | 475° C. × 7 h | 33 |
| Comp. 1 | 0 | 900° C. × 1 h | 98 | 750° C. × 10 min | 450° C. × 5 h | 29 |
| Comp. 2 | 86 | 900° C. × 1 h | 86 | 725° C. × 10 min | 450° C. × 5 h | 29 |
| Comp. 3 | 0 | — | 98 | 775° C. × 10 min | 450° C. × 5 h | 29 |
| Comp. 4 | 0 | 550° C. × 1 h | 96 | 900° C. × 10 min | 450° C. × 7 h | 65 |
| Comp. 5 | 86 | 520° C. × 6 h | 86 | 600° C. × 10 min | 450° C. × 5 h | 29 |
| Comp. 6 | 86 | 520° C. × 6 h | 86 | 925° C. × 10 min | 450° C. × 7 h | 29 |

TABLE 3

| | Ratio of Conductivities before and after Process Annealing Ea/Eb | Ratio of Vickers Hardnesses before and after Process Annealing Ha/Hb |
|---|---|---|
| Ex. 1 | 2.1 | 0.55 |
| Ex. 2 | 1.9 | 0.52 |
| Ex. 3 | 1.8 | 0.53 |
| Ex. 4 | 2.0 | 0.62 |
| Ex. 5 | 1.6 | 0.58 |
| Ex. 6 | 2.2 | 0.46 |
| Ex. 7 | 1.9 | 0.50 |
| Ex. 8 | 2.0 | 0.54 |
| Ex. 9 | 2.2 | 0.29 |
| Ex. 10 | 1.7 | 0.72 |
| Ex. 11 | 2.0 | 0.58 |
| Ex. 12 | 1.9 | 0.51 |
| Ex. 13 | 2.4 | 0.44 |
| Ex. 14 | 2.3 | 0.46 |
| Ex. 15 | 1.8 | 0.70 |
| Ex. 16 | 1.9 | 0.70 |
| Ex. 17 | 1.7 | 0.60 |
| Ex. 18 | 2.0 | 0.60 |
| Ex. 19 | 2.0 | 0.60 |
| Comp. 1 | 0.7 | 0.30 |
| Comp. 2 | 0.6 | |
| Comp. 3 | — | — |
| Comp. 4 | 1.2 | 1.33 |
| Comp. 5 | 2.0 | 0.70 |
| Comp. 6 | 2.8 | 0.40 |

TABLE 4

| | Mean Crystal Grain Size (μm) | Twin Crystal Density | Ratio of Integrated Intensities of X-ray Diffraction I{200}/I0{200} | I{200}/I{422} | Characteristics: Electric Conductivity (% IACS) | Tensile Strengh (MPa) | Bending Workability (R/t) Good way | Bending Workability (R/t) Bad way | Stress Relaxation Rate (%) |
|---|---|---|---|---|---|---|---|---|---|
| Ex. 1 | 12 | 1.3 | 3.2 | 37 | 43.1 | 722 | 0.0 | 0.0 | 4.1 |
| Ex. 2 | 8 | 1.1 | 3.0 | 20 | 40.0 | 720 | 0.0 | 0.0 | 3.8 |
| Ex. 3 | 10 | 1.2 | 2.9 | 16 | 39.4 | 701 | 0.0 | 0.0 | 3.6 |
| Ex. 4 | 9 | 1.0 | 3.8 | 52 | 54.7 | 820 | 0.0 | 0.0 | 2.9 |
| Ex. 5 | 15 | 1.1 | 3.3 | 16 | 52.2 | 702 | 0.0 | 0.0 | 3.2 |
| Ex. 6 | 8 | 0.8 | 3.5 | 50 | 43.2 | 851 | 0.0 | 0.0 | 3.4 |
| Ex. 7 | 14 | 1.2 | 3.1 | 25 | 45.1 | 728 | 0.0 | 0.0 | 3.3 |
| Ex. 8 | 12 | 1.0 | 3.2 | 27 | 43.9 | 765 | 0.0 | 0.0 | 3.8 |
| Ex. 9 | 11 | 0.9 | 3.4 | 24 | 41.9 | 762 | 0.0 | 0.0 | 3.0 |
| Ex. 10 | 10 | 0.9 | 3.0 | 18 | 55.1 | 714 | 0.0 | 0.0 | 3.2 |
| Ex. 11 | 18 | 1.0 | 2.2 | 19 | 43.0 | 730 | 0.0 | 0.0 | 4.5 |
| Ex. 12 | 24 | 1.5 | 4.2 | 38 | 44.0 | 715 | 0.0 | 0.0 | 2.3 |
| Ex. 13 | 8 | 0.7 | 3.3 | 56 | 42.7 | 852 | 0.0 | 0.3 | 2.7 |
| Ex. 14 | 9 | 0.9 | 3.1 | 55 | 40.1 | 856 | 0.0 | 0.3 | 2.8 |
| Ex. 15 | 12 | 1.1 | 3.9 | 35 | 40.0 | 878 | 0.0 | 0.0 | 3.8 |
| Ex. 16 | 12 | 1.5 | 4.0 | 46 | 39.0 | 852 | 0.0 | 0.0 | 3.2 |
| Ex. 17 | 14 | 1.2 | 4.1 | 32 | 40.0 | 898 | 0.5 | 0.5 | 3.4 |
| Ex. 18 | 12 | 1.3 | 3.9 | 44 | 42.0 | 894 | 0.0 | 0.5 | 3.5 |
| Ex. 19 | 10 | 0.5 | 1.9 | 18 | 42.0 | 847 | 1.0 | 1.0 | 6.0 |
| Comp. 1 | 10 | 0.3 | 0.5 | 2.5 | 43.4 | 733 | 0.3 | 1.3 | 6.2 |
| Comp. 2 | 7 | 0.2 | 0.4 | 5.4 | 40.1 | 713 | 0.3 | 1.3 | 6.0 |
| Comp. 3 | 9 | 0.4 | 0.2 | 6.2 | 39.1 | 691 | 0.7 | 1.3 | 5.8 |
| Comp. 4 | 8 | 0.3 | 0.3 | 10 | 57.5 | 889 | 2.0 | 3.0 | 7.2 |
| Comp. 5 | 3 | 0.4 | 0.1 | 1.9 | 55.7 | 577 | 0.0 | 0.0 | 7.5 |
| Comp. 6 | 12 | 0.9 | 2.1 | 13 | 36.7 | 871 | 1.0 | 3.3 | 3.6 |

As can be seen from the above-described results, the copper alloy sheets in Comparative Examples 1-4 substantially have the same chemical compositions of those in Examples 1-4, respectively. However, in Comparative Examples 1-4, the cold rolling and process annealing before the solution treatment were not appropriate, so that it was not possible to sufficiently store the strain energy and stacking fault energy. For that reason, the twin crystal density and the relative amount of the {200} crystal plane were insufficient, so that a large number of crystal grains having the {422} crystal plane as a principal orientation component remain. Thus, the bending workability and stress relaxation resistance of each of the sheets were deteriorated although the tensile strength and electric conductivity of each of the sheets were substantially equal to those of a corresponding one of the sheets in Examples 1-4. In Comparative Example 5, since the contents of Ni and Si were too low, the amount of the generated deposits was small, so that the strength level of the sheet was low. In Comparative Example 6, since the content of Ni was too high, the control of orientation was insufficient, so that the bending workability of the sheet was very bad although the tensile strength of the sheet was high.

Figure 2:
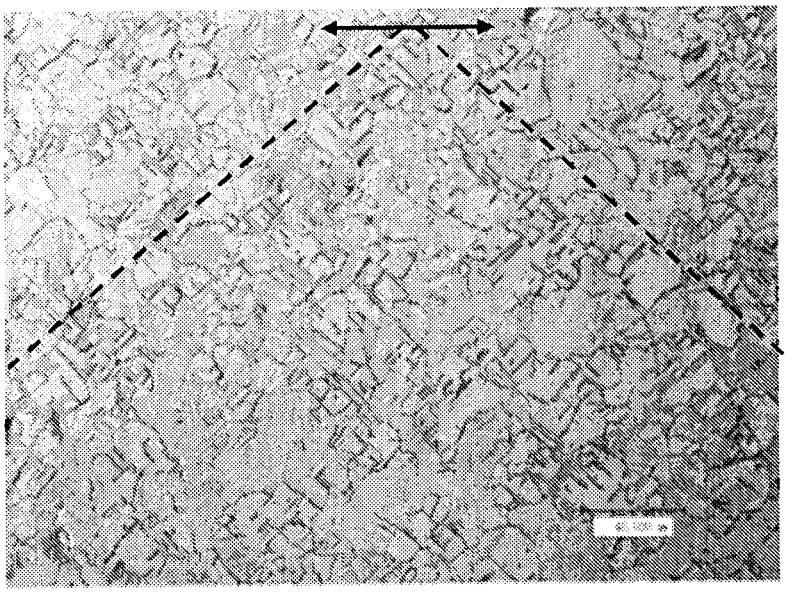
FIG. 2 is a microphotograph showing the grain structure of the surface of a copper alloy sheet in Example 3.
Figure 3:
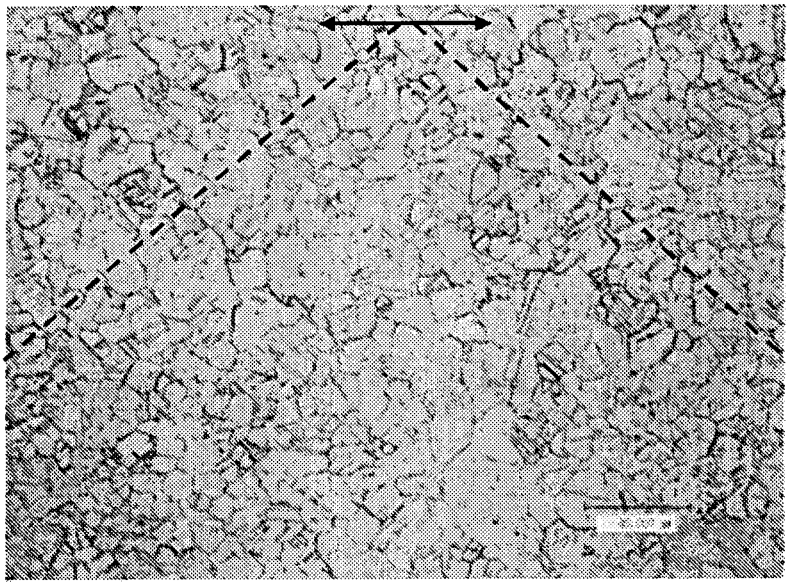
FIG. 3 is a microphotograph showing the grain structure of the surface of a copper alloy sheet in comparative Example 3.

FIG. 2 is a microphotograph showing the grain structure of the surface (rolled surface) of the copper alloy sheet in Example 3, and FIG. 3 is a microphotograph showing the grain structure of the surface (rolled surface) of the copper alloy sheet in Comparative Example 3, which has the same chemical composition as that in Example 3. In FIGS. 2 and 3, the arrows show rolling directions, and the dotted lines show directions extending at angles of 45° and 135° with respect to the rolling direction, respectively. As can be clearly seen from FIGS. 2 and 3, the copper alloy sheet in Example 3 has a larger number of twin crystals than that of the copper alloy sheet in Comparative Example 3. In addition, as shown in FIG. 2, in crystal grains having at least two twin crystals of the copper alloy sheet in Example 3, the twin crystal boundaries are substantially perpendicular to each other. From the geometrical relationship of a face centered cubic (fcc) crystalline, the {100} plane of such crystal grains is parallel to the rolling surface, and the twin crystal boundaries are parallel to the directions extending at about 45° and about 135° with respect to the rolling direction, respectively. Therefore, it can be seen that such crystal grains have the {100}<001> (Cube) direction. That is, it can be seen that, in the copper alloy sheet obtained in Example 3, the twin crystal density is high, and the percentage of crystal grains having the Cube direction is high. Thus, it is considered that the bending workability and stress relaxation resistance of the copper alloy sheet can be remarkably improved by increasing the twin crystal density and the percentage of crystal grains having the Cube orientation.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A copper alloy sheet having a thickness of 0.05 to 1.0 mm and a chemical composition consisting of 0.7 to 4.0 wt % of nickel, 0.2 to 1.5 wt % of silicon, and the balance being copper and unavoidable impurities, wherein the copper alloy sheet has a crystal orientation which satisfies $I\{200\}/I_0\{200\} \geq 1.0$ where the intensity of X-ray diffraction on the {200} crystal plane on the surface of the copper alloy sheet is I{200} and where the intensity of X-ray diffraction on the {200} crystal plane of the standard powder of pure copper is $I_0\{200\}$, wherein the copper alloy sheet has a mean crystal grain size D which is in the range of from 6 μm to 60 μm, said mean crystal grain size D being obtained without including twin crystal boundaries while distinguishing crystal grain boundaries from the twin crystal boundaries on the surface of the copper alloy sheet by the method of section based on JIS H0501, and wherein the copper alloy sheet has a mean twin crystal density $N_G=(D-D_T)/D_T$, which is not less than 0.5, said mean twin crystal density being derived from the mean crystal grain size D and a mean crystal grain size $D_T$ which is obtained while including twin crystal boundaries without distinguishing crystal grain boundaries from the twin crystal boundaries on the surface of the copper alloy sheet by the method of section based on JIS H0501.

2. A copper alloy sheet as set forth in claim 1, wherein said crystal orientation of the copper alloy sheet satisfies $I\{200\}/I\{422\} \geq 15$ where the intensity of X-ray diffraction on the {422} crystal plane on the surface of the copper alloy sheet is I{422}.

3. A copper alloy sheet having a thickness of 0.05 to 1.0 mm and a chemical composition consisting of: 0.7 to 4.0 wt % of nickel, 0.2 to 1.5 wt % of silicon; one or more elements which are selected from the group consisting of 0.1 to 1.2 wt % of tin, not higher than 2.0 wt % of zinc, not higher than 1.0 wt % of magnesium, not higher than 2.0 wt % of cobalt, and not higher than 1.0 wt % of iron; and the balance being copper and unavoidable impurities, wherein the copper alloy sheet has a crystal orientation which satisfies $I\{200\}/I_0\{200\} \geq 1.0$ where the intensity of X-ray diffraction on the {200} crystal plane on the surface of the copper alloy sheet is I{200} and where the intensity of X-ray diffraction on the {200} crystal plane of the standard powder of pure copper is $I_0\{200\}$, wherein the copper alloy sheet has a mean crystal grain size D which is in the range of from 6 μm to 60 μm, said mean crystal grain size D being obtained without including twin crystal boundaries while distinguishing crystal grain boundaries from the twin crystal boundaries on the surface of the copper alloy sheet by the method of section based on JIS H0501, and wherein the copper alloy sheet has a mean twin crystal density $N_G=(D-D_T)/D_T$, which is not less than 0.5, said mean twin crystal density being derived from the mean crystal grain size D and a mean crystal grain size $D_T$ which is obtained while including twin crystal boundaries without distinguishing crystal grain boundaries from the twin crystal boundaries on the surface of the copper alloy sheet by the method of section based on JIS H0501.

4. A copper alloy sheet having a thickness of 0.05 to 1.0 mm and chemical composition consisting of: 0.7 to 4.0 wt % of nickel, 0.2 to 1.5 wt % of silicon; one or more elements which are selected from the group consisting of chromium, boron, phosphorus, zirconium, titanium, manganese, silver, beryllium and misch metal, the total amount of these elements being not higher than 3 wt %; and the balance being copper and unavoidable impurities, wherein the copper alloy sheet has a crystal orientation which satisfies $I\{200\}/I_0\{200\} \geq 1.0$ where the intensity of X-ray diffraction on the {200} crystal plane on the surface of the copper alloy sheet is I{200} and where the intensity of X-ray diffraction on the {200} crystal plane of the standard powder of pure copper is $I_0\{200\}$, wherein the copper alloy sheet has a mean crystal grain size D which is in the range of from 6 μm to 60 μm, said mean crystal grain size D being obtained without including twin crystal boundaries while distinguishing crystal grain boundaries from the twin crystal boundaries on the surface of the copper alloy sheet by the method of section based on JIS H0501, and wherein the copper alloy sheet has a mean twin crystal density $N_G=(D-D_T)/D_T$, which is not less than 0.5, said mean twin crystal density being derived from the mean crystal grain size D and a mean crystal grain size $D_T$ which is obtained while including twin crystal boundaries without distinguishing crystal grain boundaries from the twin crystal boundaries on the surface of the copper alloy sheet by the method of section based on JIS H0501.

5. A copper alloy sheet as set forth in claim 1, wherein the copper alloy sheet has a tensile strength of not less than 700 MPa.

6. A copper alloy sheet as set forth in claim 1, wherein the copper alloy sheet has a tensile strength of not less than 800 MPa, and said crystal orientation satisfies $I\{200\}/I\{422\} \geq 50$ where the intensity of X-ray diffraction on the {422} crystal plane on the surface of the copper alloy sheet is I{422}.

7. A copper alloy sheet having a thickness of 0.05 to 1.0 mm and a chemical composition consisting of 0.7 to 4.0 wt % of nickel, 0.2 to 1.5 wt % of silicon, and the balance being copper and unavoidable impurities, wherein the copper alloy sheet has a mean crystal grain size D which is in the range of from 6 μm to 60 μm, said mean crystal grain size D being obtained without including twin crystal boundaries while distinguishing crystal grain boundaries from the twin crystal boundaries on the surface of the copper alloy sheet by the method of section based on JIS H0501 wherein the copper alloy sheet has a mean twin crystal density $N_G=(D-D_T)/D_T$, which is not less than 0.5, said mean twin crystal density being derived from the mean crystal grain size D and a mean crystal grain size $D_T$ which is obtained while including twin crystal boundaries without distinguishing crystal grain boundaries from the twin crystal boundaries on the surface of the copper alloy sheet by the method of section based on JIS H0501, and wherein the copper alloy sheet has a stress relaxation rate which is not higher than 6% after the copper alloy sheet is held at 150° C. for 1000 hours so that the maximum load stress on the surface of the copper alloy sheet is 80% of 0.2% yield strength.

8. A copper alloy sheet having a thickness of 0.05 to 1.0 mm and a chemical composition consisting of: 0.7 to 4.0 wt % of nickel, 0.2 to 1.5 wt % of silicon; one or more elements which are selected from the group consisting of 0.1 to 1.2 wt % of tin, not higher than 2.0 wt % of zinc, not higher than 1.0 wt % of magnesium, not higher than 2.0 wt % of cobalt, and not higher than 1.0 wt % of iron; and the balance being copper and unavoidable impurities, wherein the copper alloy sheet has a mean crystal grain size D which is in the range of from 6 μm to 60 μm, said mean crystal grain size D being obtained without including twin crystal boundaries while distinguishing crystal grain boundaries from the twin crystal boundaries on the surface of the copper alloy sheet by the method of section based on JIS H0501, wherein the copper alloy sheet has a mean twin crystal density $N_G=(D-D_T)/D_T$, which is not less than 0.5, said mean twin crystal density being derived from the mean crystal grain size D and a mean crystal grain size $D_T$ which is obtained while including twin crystal boundaries without distinguishing crystal grain boundaries from the twin crystal boundaries on the surface of the copper alloy sheet by the method of section based on JIS H0501, and wherein the copper alloy sheet has a stress relaxation rate which is not higher than 6% after the copper alloy sheet is held at 150° C. for 1000 hours so that the maximum load stress on the surface of the copper alloy sheet is 80% of 0.2% yield strength.

9. A copper alloy sheet having a thickness of 0.05 to 1.0 mm and a chemical composition consisting of: 0.7 to 4.0 wt % of nickel, 0.2 to 1.5 wt % of silicon; one or more elements which are selected from the group consisting of chromium, boron, phosphorus, zirconium, titanium, manganese, silver, beryllium and misch metal, the total amount of these elements being not higher than 3 wt %; and the balance being copper and unavoidable impurities, wherein the copper alloy sheet has a mean crystal grain size D which is in the range of from 6 μm to 60 μm, said mean crystal grain size D being obtained without including twin crystal boundaries while distinguishing crystal grain boundaries from the twin crystal boundaries on the surface of the copper alloy sheet by the method of section based on JIS H0501, wherein the copper alloy sheet has a mean twin crystal density $N_G=(D-D_T)/D_T$, which is not less than 0.5, said mean twin crystal density being derived from the mean crystal grain size D and a mean crystal grain size $D_T$ which is obtained while including twin crystal boundaries without distinguishing crystal grain boundaries from the twin crystal boundaries on the surface of the copper alloy sheet by the method of section based on JIS H0501, and wherein the copper alloy sheet has a stress relaxation rate which is not higher than 6% after the copper alloy sheet is held at 150° C. for 1000 hours so that the maximum load stress on the surface of the copper alloy sheet is 80% of 0.2% yield strength.

10. A copper alloy sheet as set forth in claim 7, wherein the copper alloy sheet has a tensile strength of not less than 700 MPa.

11. A copper alloy sheet as set forth in claim 7, wherein the copper alloy sheet has a tensile strength of not less than 800 MPa, and said crystal orientation satisfies $I\{200\}/I\{422\}\geq 50$ where the intensity of X-ray diffraction on the {422} crystal plane on the surface of the copper alloy sheet is $I\{422\}$.

12. An electric and electronic part, wherein a copper alloy sheet as set forth in any one of claims 1, 2 and 3 through 11 is used as the material thereof.

13. An electric and electronic part as set forth in claim 12, which is any one of a connector, a lead frame, a relay and a switch.

14. A copper alloy sheet as set forth in claim 1, wherein the copper alloy sheet has a stress relaxation rate which is not higher than 6% after the copper alloy sheet is held at 150° C. for 1000 hours so that the maximum load stress on the surface of the copper alloy sheet is 80% of 0.2% yield strength.

15. A copper alloy sheet having a thickness of 0.05 to 1.0 mm and a chemical composition consisting of: 0.7 to 4.0 wt % of nickel, 0.2 to 1.5 wt % of silicon; one or more elements which are selected from the group consisting of 0.1 to 1.2 wt % of tin, not higher than 2.0 wt % of zinc, not higher than 1.0 wt % of magnesium, not higher than 2.0 wt % of cobalt, and not higher than 1.0 wt % of iron; one or more elements which are selected from the group consisting of chromium, boron, phosphorus, zirconium, titanium, manganese, silver, beryllium and misch metal, the total amount of these elements being not higher than 3 wt %; and the balance being copper and unavoidable impurities, wherein the copper alloy sheet has a crystal orientation which satisfies $I\{200\}/I_0\{200\}\geq 1.0$ where the intensity of X-ray diffraction on the {200} crystal plane on the surface of the copper alloy sheet is $I\{200\}$ and where the intensity of X-ray diffraction on the {200} crystal plane of the standard powder of pure copper is $I_0\{200\}$, wherein the copper alloy sheet has a mean crystal grain size D which is in the range of from 6 μm to 60 μm, said mean crystal grain size D being obtained without including twin crystal boundaries while distinguishing crystal grain boundaries from the twin crystal boundaries on the surface of the copper alloy sheet by the method of section based on JIS H0501, and wherein the copper alloy sheet has a mean twin crystal density $N_G=(D-D_T)/D_T$, which is not less than 0.5, said mean twin crystal density being derived from the mean crystal grain size D and a mean crystal grain size $D_T$ which is obtained while including twin crystal boundaries without distinguishing crystal grain boundaries from the twin crystal boundaries on the surface of the copper alloy sheet by the method of section based on JIS H0501.

16. A copper alloy sheet having a thickness of 0.05 to 1.0 mm and a chemical composition consisting of: 0.7 to 4.0 wt % of nickel, 0.2 to 1.5 wt % of silicon; one or more elements which are selected from the group consisting of 0.1 to 1.2 wt % of tin, not higher than 2.0 wt % of zinc, not higher than 1.0 wt % of magnesium, not higher than 2.0 wt % of cobalt, and not higher than 1.0 wt % of iron; one or more elements which are selected from the group consisting of chromium, boron, phosphorus, zirconium, titanium, manganese, silver, beryllium and misch metal, the total amount of these elements being not higher than 3 wt %; and the balance being copper and unavoidable impurities, wherein the copper alloy sheet has a mean crystal grain size D which is in the range of from 6 μm to 60 μm, said mean crystal grain size D being obtained without including twin crystal boundaries while distinguishing crystal grain boundaries from the twin crystal boundaries on the surface of the copper alloy sheet by the method of section based on JIS H0501, wherein the copper alloy sheet has a mean twin crystal density $N_G=(D-D_T)/D_T$, which is not less than 0.5, said mean twin crystal density being derived from the mean crystal grain size D and a mean crystal grain size $D_T$ which is obtained while including twin crystal boundaries without distinguishing crystal grain boundaries from the twin crystal boundaries on the surface of the copper alloy sheet by the method of section based on JIS H0501, and wherein the copper alloy sheet has a stress relaxation rate which is not higher than 6% after the copper alloy sheet is held at 150° C. for 1000 hours so that the maximum load stress on the surface of the copper alloy sheet is 80% of 0.2% yield strength.

17. A copper alloy sheet as set forth in claim 3, wherein said crystal orientation of the copper alloy sheet satisfies I{200}/I{422}≥15 where the intensity of X-ray diffraction on the {422} crystal plane on the surface of the copper alloy sheet is I{422}.

18. A copper alloy sheet as set forth in claim 3, wherein the copper alloy sheet has a tensile strength of not less than 700 MPa.

19. A copper alloy sheet as set forth in claim 3, wherein the copper alloy sheet has a tensile strength of not less than 800 MPa, and said crystal orientation satisfies I{200}/I{422}≥50 where the intensity of X-ray diffraction on the {422} crystal plane on the surface of the copper alloy sheet is I{422}.

20. A copper alloy sheet as set forth in claim 4, wherein said crystal orientation of the copper alloy sheet satisfies I{200}/I{422}≥15 where the intensity of X-ray diffraction on the {422} crystal plane on the surface of the copper alloy sheet is I{422}.

21. A copper alloy sheet as set forth in claim 4, wherein the copper alloy sheet has a tensile strength of not less than 700 MPa.

22. A copper alloy sheet as set forth in claim 4, wherein the copper alloy sheet has a tensile strength of not less than 800 MPa, and said crystal orientation satisfies I{200}/I{422}≥50 where the intensity of X-ray diffraction on the {422} crystal plane on the surface of the copper alloy sheet is I{422}.

23. A copper alloy sheet as set forth in claim 15, wherein said crystal orientation of the copper alloy sheet satisfies I{200}/I{422}≥15 where the intensity of X-ray diffraction on the {422} crystal plane on the surface of the copper alloy sheet is I{422}.

24. A copper alloy sheet as set forth in claim 15, wherein the copper alloy sheet has a tensile strength of not less than 700 MPa.

25. A copper alloy sheet as set forth in claim 15, wherein the copper alloy sheet has a tensile strength of not less than 800 MPa, and said crystal orientation satisfies I{200}/I{422}≥50 where the intensity of X-ray diffraction on the {422} crystal plane on the surface of the copper alloy sheet is I{422}.

26. A copper alloy sheet as set forth in claim 8, wherein the copper alloy sheet has a tensile strength of not less than 700 MPa.

27. A copper alloy sheet as set forth in claim 8, wherein the copper alloy sheet has a tensile strength of not less than 800 MPa, and said crystal orientation satisfies I{200}/I{422}≥50 where the intensity of X-ray diffraction on the {422} crystal plane on the surface of the copper alloy sheet is I{422}.

28. A copper alloy sheet as set forth in claim 9, wherein the copper alloy sheet has a tensile strength of not less than 700 MPa.

29. A copper alloy sheet as set forth in claim 9, wherein the copper alloy sheet has a tensile strength of not less than 800 MPa, and said crystal orientation satisfies I{200}/I{422}≥50 where the intensity of X-ray diffraction on the {422} crystal plane on the surface of the copper alloy sheet is I{422}.

30. A copper alloy sheet as set forth in claim 16, wherein the copper alloy sheet has a tensile strength of not less than 700 MPa.

31. A copper alloy sheet as set forth in claim 16, wherein the copper alloy sheet has a tensile strength of not less than 800 MPa, and said crystal orientation satisfies I{200}/I{422}≥50 where the intensity of X-ray diffraction on the {422} crystal plane on the surface of the copper alloy sheet is I{422}.

32. An electric and electronic part, wherein a copper alloy sheet as set forth in any one of claims 15 through 31 is used as the material thereof.

33. An electric and electronic part as set forth in claim 32, which is any one of a connector, a lead frame, a relay and a switch.

34. A copper alloy sheet as set forth in any one of claims 3, 4, 15, wherein the copper alloy sheet has a stress relaxation rate which is not higher than 6% after the copper alloy sheet is held at 150° C. for 1000 hours so that the maximum load stress on the surface of the copper alloy sheet is 80% of 0.2% yield strength.

35. A copper alloy sheet as set forth in any one of claims 1, 2, 3-11, 14 and 15-31, wherein said crystal orientation satisfies $\{200\}/I_0\{200\}\geq 2.0$.

36. A copper alloy sheet as set forth in any one of claims 1, 2, 3-11, 14 and 15-31, wherein said mean twin crystal density $N_G=(D-D_T)/D_T$ is not less than 0.7.

* * * * *